US006550645B2

(12) United States Patent
Nelson et al.

(10) Patent No.: US 6,550,645 B2
(45) Date of Patent: Apr. 22, 2003

(54) METHOD AND APPARATUS FOR SHIPPING BULK LIQUID, NEAR-LIQUID AND DRY PARTICULATE MATERIALS

(75) Inventors: Charles M. Nelson, Houston, TX (US); James D. Patton, Ft. Worth, TX (US)

(73) Assignee: Cortainer Patent Warehouse, L.L.C., Houston, TX (US)

( * ) Notice: Subject to any disclaimer, the term of this patent is extended or adjusted under 35 U.S.C. 154(b) by 191 days.

(21) Appl. No.: 09/785,907

(22) Filed: Feb. 16, 2001

(65) Prior Publication Data

US 2001/0023891 A1 Sep. 27, 2001

Related U.S. Application Data

(60) Provisional application No. 60/183,064, filed on Feb. 16, 2000.

(51) Int. Cl.[7] ..... B65D 5/60

(52) U.S. Cl. ..... 222/105; 222/146.1; 222/146.2; 222/146.6; 222/386.5; 229/109; 229/117.3; 248/152

(58) Field of Search ..... 222/92, 93, 105, 222/386.5, 183, 481, 146.1, 146.2, 146.6; 229/109, 110, 117.3; 248/152

(56) References Cited

U.S. PATENT DOCUMENTS 3,123,254 A * 3/1964 Rabby et al. ..... 222/105
4,205,775 A * 6/1980 Swan ..... 229/110
4,421,253 A * 12/1983 Croley ..... 222/105
4,666,059 A * 5/1987 Nordstrom ..... 222/105
4,742,951 A * 5/1988 Kelly et al. ..... 229/109
4,771,917 A * 9/1988 Heaps et al. ..... 222/105
4,850,506 A * 7/1989 Heaps et al. ..... 222/105
RE33,128 E * 12/1989 Nordstrom ..... 222/105
5,050,775 A * 9/1991 Marquardt ..... 222/105
5,351,849 A * 10/1994 Jagenburg et al. ..... 229/117.3
5,803,346 A * 9/1998 Baker et al. ..... 229/117.3
6,000,549 A * 12/1999 Perkins ..... 229/117.27

* cited by examiner

*Primary Examiner*—Kenneth Bomberg
(74) *Attorney, Agent, or Firm*—The Matthews Firm; William E. Johnson, Jr.

(57) ABSTRACT

A flexible bladder is enclosed within a plurality of overlapping plastic sheets, with the ends of the sheets being secured in place by the weight of the flexible bladder, when filled. The preferred plastic is an extruded, twin-walled, fluted plastic based upon a polypropylene copolymer. In a alternative embodiment, a pair of hexagonal, coaxial sleeves of the preferred plastic have an internal bladder for shipping materials. With both embodiments, hot chocolate is pumped into the bladder and cooled, in situ, to stop the chocolate from cooking further. The container is shipped, and then the chocolate is heated to facilitate pumping the chocolate out of the container. The cooling and heating processes involve the use of a heat exchange pad located between the bladder and the inner sleeve.

6 Claims, 18 Drawing Sheets

METHOD AND APPARATUS FOR SHIPPING BULK LIQUID, NEAR-LIQUID AND DRY PARTICULATE MATERIALS

RELATED APPLICATION

This application claims priority from U.S. Provisional Patent Application Ser. No. 60/183,064, filed Feb. 16, 2000.

BACKGROUND OF THE INVENTION

The present invention relates, generally, to methods and apparatus for shipping bulk liquids, near-liquids or dry particulate materials in a flexible inner tank within a steel container and specifically, to methods and apparatus providing a liner between the inner tank and the interior walls of the steel container which not only provides some protection against moisture and chemical degradation, but which also adds mechanical and fluid stability around the exterior of the flexible inner tank to prevent the rolling and sloshing of the materials within the flexible inner tank.

PRIOR ART

It is well recognized in the shipping art that it is generally desirable to ship pumpable materials in bulk containers, both as to the economies of scale and as to the handling and distribution of the shipping containers.

The prior art has produced various liners for shipping materials. For example, U.S. Pat. No. 5,506,020 to Haberkorn shows an insulating freight container quilt including components of spun-bonded polypropylene and polyester which may be placed over articles in a truck.

U.S. Pat. No. 5,143,245 to Malone discloses a thick bag of air cell polyethylene wrapper around cargo placed in a shipping container.

U.S. Pat. No. 5,027,946 to Parsons shows an insulating sheet wrap for a bundle of shingles.

U.S. Pat. No. 5,312,162 to Baebel discloses a plurality of sheets placed within a transport vehicle to facilitate the removal of a powder or particulate load from the vehicle.

U.S. Pat. No. 5,687,517 to Wiercinski, et al., discloses a corrugated polypropylene and/or polyethylene laminate for use in a roofing environment.

U.S. Pat. No. 3,684,642 to Rogers shows a corrugated polypropylene film intended for the packing industry.

U.S. Pat. No. 5,102,036 to Orr et al., shows a corrugated insulated wrap, constructed of paper.

U.S. Pat. No. 4,282,279 to Strickland is illustrative of many patents showing insulating sheets in wrapped proximity to various articles.

U.S. Pat. No. 4,457,986 to Barris et al., and U.S. Pat. No. 3,752,354 to Demirag, each discloses flexible bladders for liquid products positioned within a rigid enclosure.

U.S. Pat. No. 5,518,171 to Moss shows corrugated plastic sheets having slots for connecting together.

U.S. Pat. No. 5,766,395 to Bainbridge et al., discloses a wood fiber-filled polypropylene sheet sand a corrugated paperboard medium.

The prior art has attempted to both protect the inner liner and to make the system impervious to invasion by moisture and chemicals using other methods and apparatus. For example, it is known with intermediate bulk containers ("IBC"), to use a corrugated paperboard (or cardboard) liner around the flexible bladder, and then to surround the corrugated liner with a plastic wrap in an attempt to keep the corrugated liner from being exposed to moisture. Exposure to moisture or chemicals would, in most cases, destroy the paperboard liner.

It is also known in the prior art to merely make the flexible bladder itself stronger, thicker and resistant to moisture, without using any liner external to the bladder. These attempts involve heavy duty rubberized bladders which, while having limited success, cannot often be used with food grade materials because of the materials absorbing the odor from the rubberized bladder itself.

The prior art also has included a foldable blanket apparatus having a liner around the flexible bladder having a flexible polyester coated fabric outer liner with a multi-layered, flexible disposable inner liner which, while providing some protection to the bladder from moisture and chemicals, offers no mechanical support to prevent hurling and sloshing of the fluid, and which are quite expensive, requiring that the liners be shipped back to the point of origin. Such liners are available from Crestbury Limited, Hempstead Road, Holt, Norfolk NR 25 6DL England, under their Multibulk trademark.

The prior art has also recognized the problem of shipping fluids through reduced temperature regions of the world. For example, when shipping corn syrup, the syrup usually must be heated before the syrup can be pumped out of the container. In U.S. Pat. No. 302,017 to E.L. Orcutt, especially in FIG. 4, a steam jacket is placed around the bottom of a kettle A to cause the sugar syrup to flow easily.

In U.S. Pat. No. 1,562,991 to E. A. Rudigier, a railway tank car is equipped with tubes running through the interior of the tank through which steam or other heating fluid can be supplied to heat the transported material and facilitate the unloading of the transported material.

In U.S. Pat. No. 3,945,534 to E. W. Ady, there is a disclosure of a flexible bag containing an unidentified food, and having a bag containing a processing fluid 24 for heating the food within the container.

U.S. Pat. No. 3,583,415 to V. D. Smith shows a plurality of corn syrup tanks equipped with a heat exchanger and hot water tubes both within and around tube 88 carrying the corn syrup, to heat the syrup and thus allow the continuous flow of the liquid syrup.

U.S. Pat. No. 4,454,945 to S. A. Jabarin et al., shows a flexible bag 21 transported within a crate or box, but containing no method or apparatus for heating the contents within the flexible bag.

The prior art also includes stainless steel or carbon steel tanks, transportable by tractor-trailer trucks or the like, having steam channels on the lower half of the tanks, and on some designs, around the circumference. Such tanks, sometimes knows as "ISOTANKS", are widely available, for example, from Twinstar Leasing, Ltd., located at 1700 One Riverway, Houston, Tex. 77056.

U.S. Pat. No. 5,884,814 to Charles M. Nelson, describes a system for heating the materials in flexible bladders to ensure the pumpability of the materials out of the bladders at the final destination. The teaching of U.S. Pat. No. 5,884,814 is incorporated herein by reference but is, for the most part, repeated hereinafter to facilitate the understanding of the present invention.

The prior art has failed, however, to provide a system in which a large flexible bladder, designed to hold on the order of 40,000 pounds of pumpable material, can be transported in a 20' long steel shipping container, and yet be protected to a degree from moisture and chemicals, and be protected from hurling and sloshing of the huge volume of pumpable material, which otherwise can bring about the destruction of the bladder and the catastrophic leaking of the materials shipped.

It is therefore the primary object of the present invention to provide methods and apparatus involving the use of new and improved external liners for flexible bladders at least partially filled with liquid materials.

It is also an object of the present invention to provide methods and apparatus involving the use of new and improved external liners for flexible bladders at least partially filled with partially frozen liquid materials.

It is yet another object of the present invention to provide methods and apparatus involving the use of new and improved external liners for flexible bladders at least partially filled with dry, granulated or powdered materials.

These and other objective features and advantages of the present invention will become apparent from a reading of the following detailed description of the invention, taken in conjunction with the accompanying drawings.

BRIEF DESCRIPTION OF THE DRAWINGS

FIG. 21 is an isometric view of the door end cap according to the alternative embodiment of the invention into which the third support band illustrated in FIG. 20 has been slided in;

DESCRIPTION OF THE PREFERRED EMBODIMENT

Figure 1:
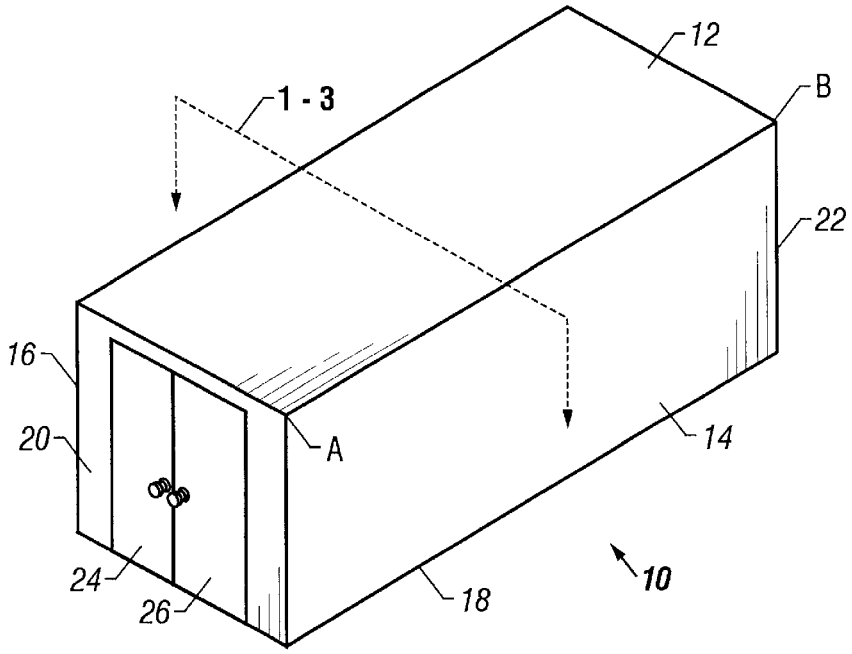
FIG. 1 is a pictorial, isometric view of a steel-bodied shipping container used with the system according to the present invention.

FIG. 1 is a pictorial, isometric view of a steel bodied shipping container 10 having nominal dimensions of 20 feet long (between points A and B), 8 feet wide and 8 feet high. Such shipping containers, having the shape of a parallelepiped box, are conventional and are available also in 40 foot length sizes. The top plate 12, the side plates 14 and 16, the end plates 20 and 22, and the bottom plate 18 are all welded together, with the only access to the interior of the shipping container 10 being through a pair of lockable steel doors 24 and 26. The left door 24 in the shipping container 10 is usually left locked closed during the loading, unloading, and shipping of the container 10 to provide mechanical strength. As will be explained hereinafter, the right hand door 26 provides access for the pumping operations, both loading and unloading.

Figure 2:
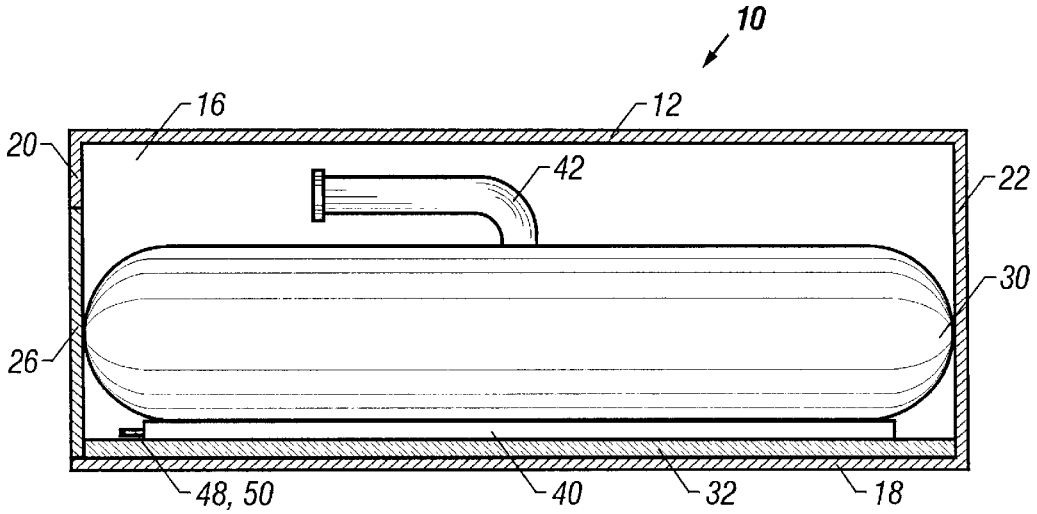
FIG. 2 is an elevated side view, partly in cross-section, of a flexible container in its full mode within the shipping container of FIG. 1 according to the present invention.
Figure 3:
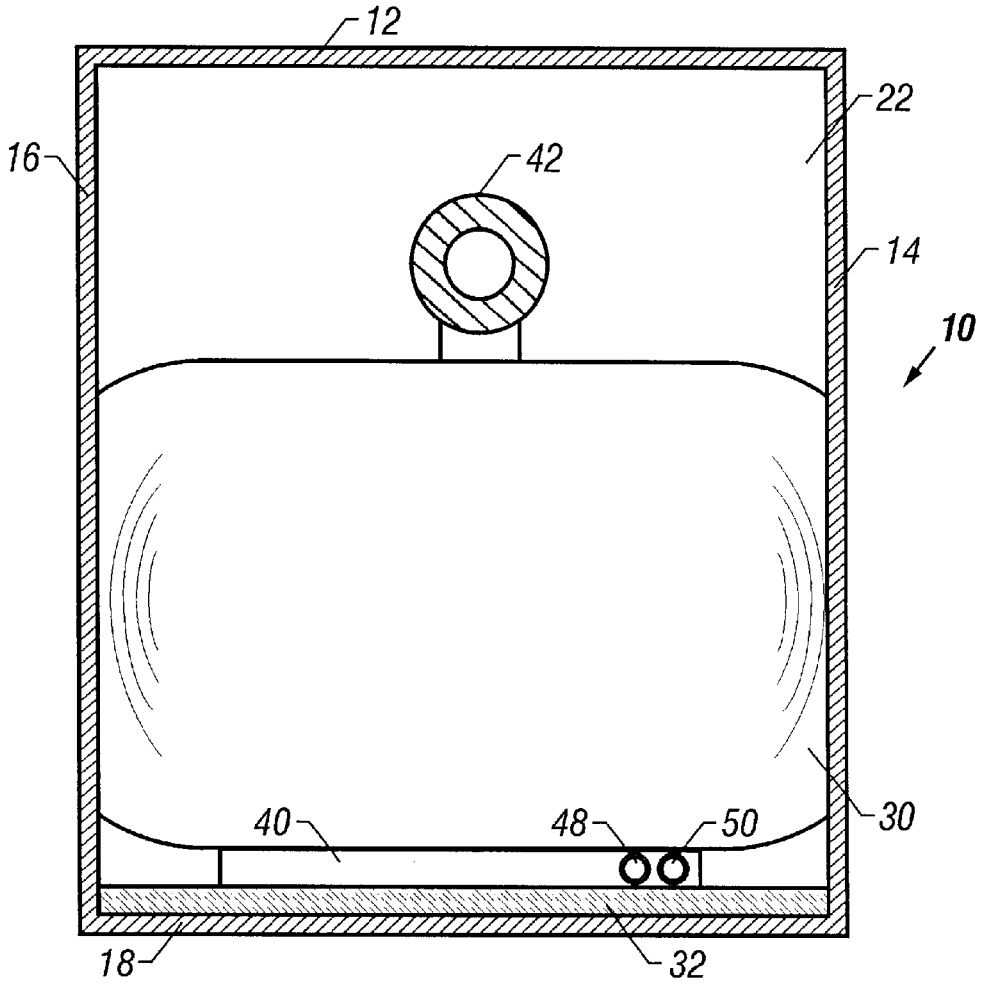
FIG. 3 is an elevated end view, partly in cross-section, taken along the sectional lines 1–3 of FIG. 1 according to the present invention.
Figure 4:
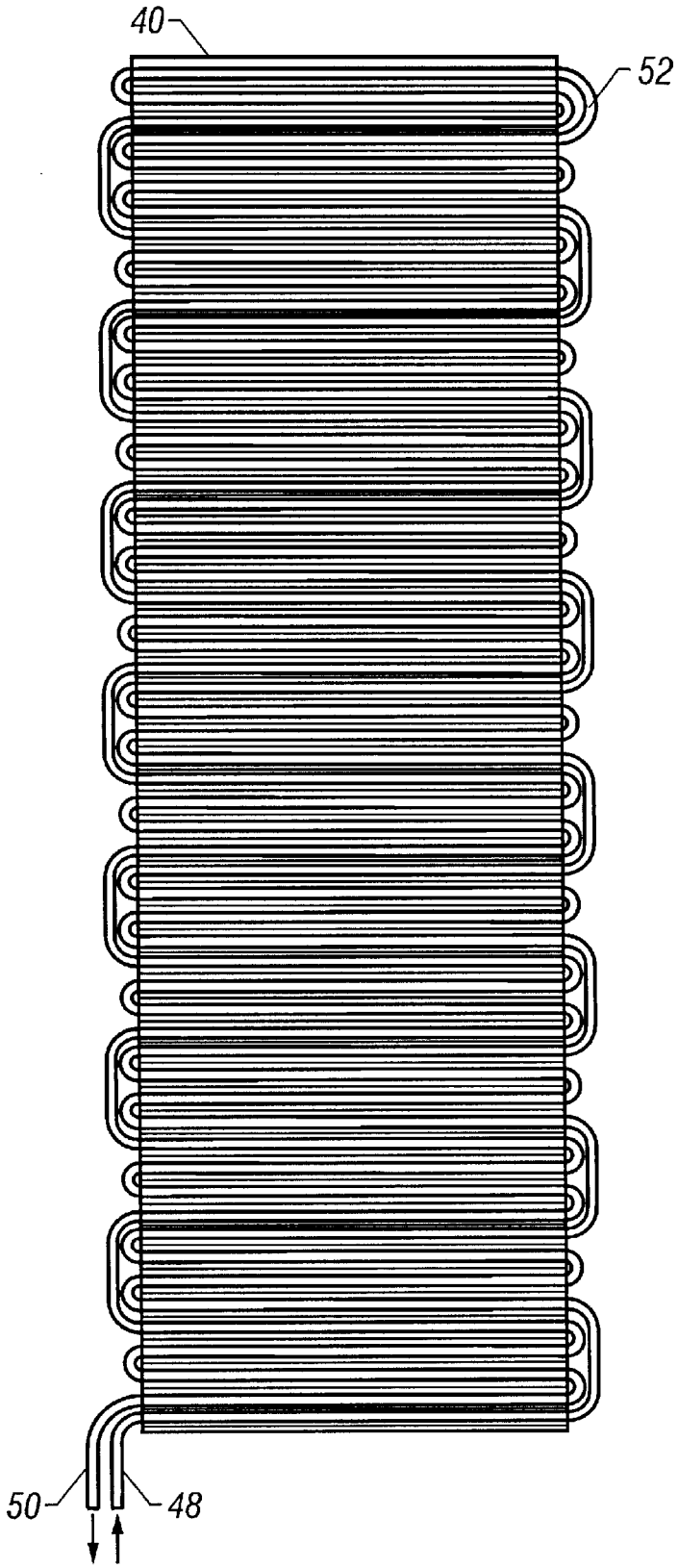
FIG. 4 is a bottom plan view of the heat exchanger pad used with the present invention.

FIG. 2 illustrates a flexible bladder 30 which is illustrated in its full mode, being full of corn syrup, for example. The flexible tank 30 is positioned immediately on top of the optional heat exchanger pad 40. The heat exchanger pad 40, described in more detail with respect to FIGS. 3 and 4, is resting upon an insulation pad 32, which in the preferred embodiment is two-inch thick isocynurate foam. The insulating pad 32 can be made in a rectangular pattern 20 feet by 8 feet, or slightly less to coincide with the interior dimension of the bottom plate 18 of the shipping container 10, or can be made smaller if desired to match the dimensions of pad 40.

The flexible tank 30 is preferably constructed out of ultra-low density polyethylene (ULDPE), co-extruded, and comprises two 3-ply layers, with each layer ply being 1.5 mm thick. These two layers are thus each 4.5 mm thick, together forming the flexible inner tank 30 having an overall thickness of 9 mm. This tank 30 has been certified to comply with FDA requirements set out in 21 C.F.R. 117.15203.2a, which allows the use of the flexible inner tank 30 to be used in direct food contact applications. The tank 30 contains a flexible hose connection 42 for pumping materials into and out of the flexible bladder 30 through the access door 26.

Referring now to FIG. 3, there is illustrated a view, partly in cross section, of the shipping tank 10, taken along the sectional lines 1–3 of FIG. 1, illustrating the flexible bladder 30, in its full mode, resting on the pad 40, which is positioned on insulating pad 32, which in turn is positioned on the bottom plate or floor 18 of the shipping container 10. The pad 40 is illustrated as having a plurality of parallel sections, coupled with loops, terminating in an inlet connection 48 and an outlet 50, together forming a hose 46 described with respect to FIG. 4.

FIG. 4 illustrates in a bottom plan view the pad 40 containing a hose 46 sewn into the pad in a pattern particularly useful for the present invention, in that the inlet 48 and the outlet 50 for the hose 46 are in near proximity. This is especially advantageous in that access to the hose 46 is severely limited, accessible only through the right hand door 26 of the shipping container 10, in a very limited space. In the preferred embodiment, for use with a 20foot shipping container 10, the pad 40 is 225 inches long, approximately 18½ feet, and 6 feet wide. Being only 6 feet wide allows room for the loops 52 within the internal dimension of the container 10 which is slightly less than 8 feet wide.

The pad 40, analogous to an envelope, is constructed of two sheets of weatherproof material, for example, tarpaulin. The hose 46 is laid out in the pattern illustrated on the bottom sheet of the pad 40. The top and bottom sheets are sewn together in 3¾ inch parallel seams to hold the hose pattern in place, there being 60 parallel pockets holding the hose 46 in its desired pattern. The hose 46 is 550 feet long. The preferred hose 46 is double walled, with a helical wound nylon inner support, having a ½ inch I.D. and 13/16 O.D., rated at 150 PSI @ 200° F. One of the seams is between each of the lengths of the hose 46 to prevent any rubbing or tangling of the hose.

In the initial stage of the operation of the system illustrated in FIGS. 1–4, both of the doors 24 and 26 of the shipping container 10 are opened and the insulating pad 32 positioned on the floor, being lower plate 18. The pad 40 is then placed on top of the pad 32, with the hose inlet and outlet being positioned at the entrance into the container 10 next to the right hand door 26. The flexible bladder 30, in its empty mode, is available in a plasticized fabric shipping valise. When empty, the flexible bladder is essentially flat. The bladder 30 is removed from the valise and placed on top of the pad 40, being careful to arrange the end of hose 42 close to the access door 26. The access ends 48 and 50 of hose 46 are also close to the access door 26. The hose 42 is flexible and can easily be connected to another hose (not illustrated) from which the pumped material, for example, corn syrup, can be pumped through the access door 26. The material being pumped into the flexible container is usually heated to facilitate the pumping into the flexible container, using conventional heating and pumping facilities, not illustrated. From the time the pumping of the material into the bladder 30 commences, until the material is finally pumped out of the bladder 30, the left-hand door 24 is locked shut to provide mechanical integrity for the system. Once the bladder 30 is pumped full, the hose 42 is disconnected from the source of the pumped material, at which point the right door 26 is locked shut and the container 10 can be shipped via railroad, trucks, ships, aircraft, or any other available means of shipping.

The problems associated with shipping materials in large flexible containers are immense. When loaded, such flexible containers may weigh almost 50,000 pounds and are accessible only through a single door at one end of the steel shipping container. Depending upon the specific gravity of the material, different volume sizes of the flexible bladder may be used to handle the weight restrictions imposed by the various government agencies, but the typical flexible bladders used in 20-foot shipping containers will hold between 4,000 and 6,000 gallons of material. The invention, as an option, contemplates the shipping in flexible bladders of any non-hazardous bulk liquid requiring heat to facilitate pumping of the material, i.e., corn syrup, drilling fluids used for drilling oil and gas wells, etc.

At the shipping destination, either steam or hot water can be applied through the inlet hose opening 48, which will then exit through the hose outlet 50. We have found that the 550 feet of heat transfer hose, when energized with untrapped low pressure (20 lbs.) steam at 220–230° F., will heat 4,000 gallons of water, initially at 65° F., to 125° F. in 48 hours. Because of the fairly large heat transfer area of the pad 40, approximately 6 feet by 18.5 feet, the system is not as likely to damage sensitive products as is seen with the smaller heat transfer areas used in the prior art. If slower heat-up is required, hot water can be used in place of the steam.

The insulated pad 32 is somewhat optional, and usually is not needed other than when the system is exposed to temperatures lower than 50° F. ambient. If not used, however, in such lower ambient temperatures, the heat from the pad 40 will be partially lost through the bottom plate 18, causing the heat-up period to be increased.

If desired, when using the system in very cold ambient temperatures, for example, below 35° F., an additional heat exchanger pad such as pad 40 can be placed around the sides of the bladder 30 and steam or hot water run through its hoses to speed up the heat-up period.

Once the material has been pumped out of the bladder 30 at the shipping destination, the bladder 30 is either folded up and shipped back to the shipper or disposed of, depending upon the type of bladder used. The pad 40 is folded up, placed in its shipping valise and returned to the desired location for re-use.

The following tests were conducted to determine the optimum operating conditions for the system according to the invention:

EXAMPLE 1

A standard 20 foot shipping container was fitted with two-inch isocynurate foam insulation with a stabilized K-Factor of 0.14 Btu-in/ft2 (aluminum foil both sides) on the floor, sides and ends. Insulation compressive strength of 25 psi allowed the installation and fitting crew to walk on the insulation without damage. The top of the loaded flexible tank was covered with a 2 two-inch fiberglass blanket. Average ambient temperature was 55° F.

The heating pad was fitted over the floor insulation and a 23,000 liter R tank was fitted over the heating pad. The heating pad did not interfere with the flexible tank fitting. Insulating and fitting took two men 45 minutes.

The flexible tank was loaded with 4,000 gallons of water at 60° F. and heated to 80° F. with a standard home hot water heater. This proved ineffective and low pressure steam at 50 psi/230° F. was then used to energize the heating hose. The bottom of the flexible tank was exposed to a maximum temperature of 200° F.

A standard crows foot twist lock coupling was used to connect to the steam manifold. The steam manifold was set at 30 psi. This fluctuated as low as 20 psi in a transient state as other demands were put on the steam manifold.

The 4,000 gallons of water reached a maximum temperature of 140° F. over a 24-hour period, after the change to steam, while average ambient temperatures fell from 65° F. to 50° F.

The steam was turned off and the flexible tank allowed to cool. The first 12 hours saw a drop of 10° F. to 130° F. with an average ambient temperature of 55° F. The next 12 hours the temperature dropped to 115° F. as the average ambient temperature dropped to 50° F. No further readings were taken.

The flexible tank was drained and moved for further testing. Inspection of the heating hose and the flexible tank showed little or no wear and tear.

EXAMPLE 2

The second series started with the test water at 65° F. and open steam at 25 pounds pressure. There was no insulation on the top of the flexible tank but the floor and side insulation were installed in the container as before. The average ambient temperature was 60° F. In the first 24 hours the temperature rose to 101° F. and over the next 24 hours rose to 122° F.

The flexible tank was drained. Inspection indicated little or no wear and tear.

The test flexible tank and heating pad were refitted into the container and the third test series run.

EXAMPLE 3

The third series started with the test water at 65° F. and open steam at 25 pounds pressure. There was no insulation on the top of the flexible tank but the floor and side insulation was installed in the container as before. The average ambient temperature was 65° F. In the first 24 hours the test water temperature rose to 101° F. and over the next 24 hours rose to 122° F.

EXAMPLE 4

The fourth series started with the test water at 67° F. and open steam at 25 pounds pressure. There was no insulation on the top of the flexible tank and the floor and side insulation was removed. The average ambient temperature was 60° F. In the first 24 hours the test water temperature rose to 88° F. and over the next 24 hours rose to 108° F.

Figure 5:
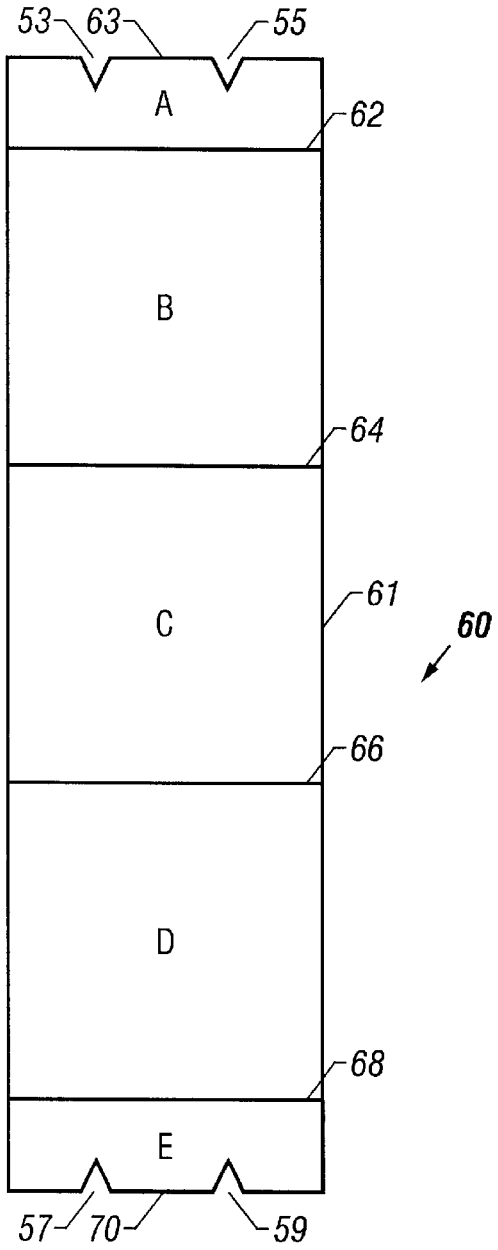
FIG. 5 is a plan view of a sheet of the plastic material used in accord with the present invention.

Referring now to FIG. 5, there is illustrated a flat section 60 of extruded, twin-walled fluted plastic based upon a polypropylene copolymer available from Coroplast, Inc., 4501 Spring Valley Road, Dallas, Tex. 75244, under their COROPLAST Trademark. For ease of reference, the plastic will sometimes be referred to hereinafter as the "COROPLAST material". The section 60 is preferably between 3 and 10 mm thick, but in the most preferred embodiment is 8 mm thick, and is approximately 22 feet long, as measured along the line 61, and 8 feet wide, as measured along the line 63. The plastic sheet 60 has two pair of v-shaped alignment notches, 53, 55, 57 and 59. The section 60, after extrusion, is scored along the lines 62, 64, 66 and 68. The score line 62 is 3 feet from the end line 63. The score line 64 is approximately 4 feet from the score line 62, but typically, can vary between 3 and 6 feet, depending upon the amount of material to be pumped into the flexible inner tank 30. The score lines 64 and 66 are 8 feet apart. The score lines 68 and 70 are 3 feet apart. The score lines 66 and 68 are typically approximately 4 feet apart, but the distance can vary as does the distance between the score lines 62 and 64.

As will be described in greater detail hereinafter, the scoring of the COROPLAST material allows the material to be easily bent along the score lines to result in the five distinct sections A, B, C, D and E. The scoring process, as used throughout this specification, does not cut the COROPLAST material at all, but rather crushes the material from one side to the other, resulting in a flexible hinge along the entire length of the scoring line having essentially an infinite number of bending cycles without breaking or tearing the material.

Figure 6:
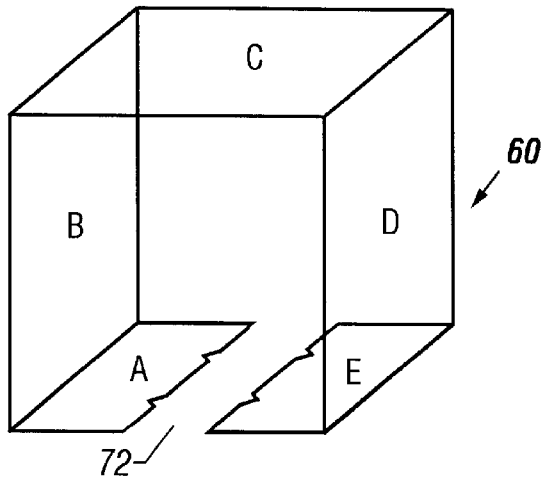
FIG. 6 is an elevated isometric view of the plastic sheet of FIG. 5 configured into a support band according to the present invention.

As illustrated in FIG. 6, the support band 60 is easily bent along the score lines 62, 64, 66 and 68, leaving a gap 72 approximately 2 feet wide between the flaps A and E. Because the steel shipping container 10 in FIG. 1 is 8 feet wide and 8 feet high, the support band 60 can be fitted quite easily within the container 10, around the inner liner 30, illustrated in FIGS. 2 and 3.

The present invention contemplates the use of a plurality, preferably nine, of overlapping support bands, each having the configuration illustrated in FIG. 6, together enveloping the inner liner 30, with two end caps also formed from the COROPLAST material, one at each end of the container 10, and adding to the enveloping of the flexible inner liner 30.

Figure 7:
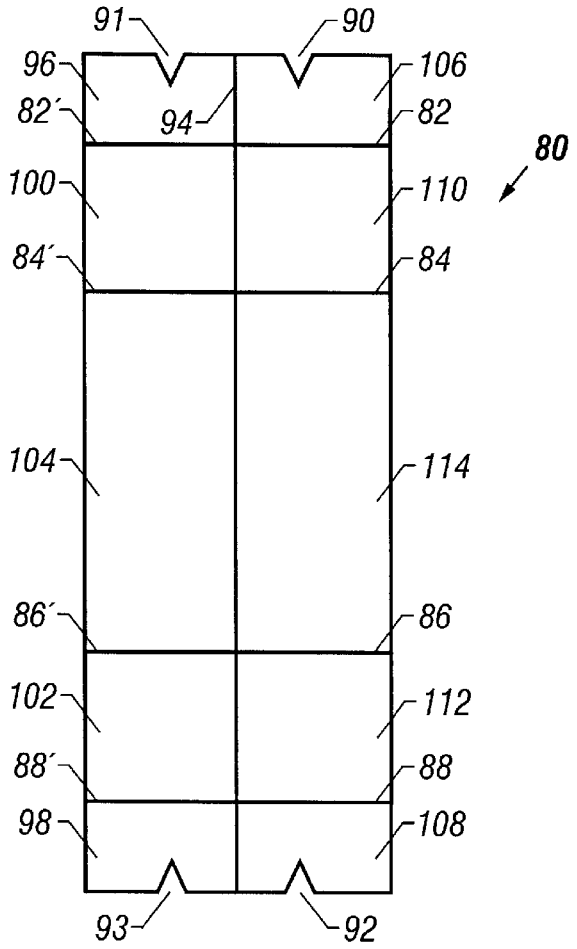
FIG. 7 is a plan view of a sheet of the plastic material used in accord with the present invention.

Referring now to FIG. 7, there is illustrated a flat section 80 of the COROPLAST material, preferably 4 mm thick, but which can vary between 3 and 10 mm thick, scored along the transverse lines 82, 84, 86 and 88, and having one pair of v-shaped alignment notches 90 and 92. The section 80 is also scored along the line 94. The portions of lines 82, 84, 86 and 88 to the left side of the scored line 94, identified as lines $82^1$, $84^1$, $86^1$ and $88^1$, respectively, are cut all the way through the COROPLAST material, to result in two bottom flaps 96 and 98, two side flaps 100 and 102, and a top flap 104. The portion of the section 80 containing the bottom edges 106 and 108, the sides 110 and 112, and the top 114, together with the flaps 96, 98, 100, 102 and 104, are formed together in FIG. 8 into one of the end caps, and a second end cap is made from an identical sheet, such as sheet 80, using the identical process.

Figure 8:
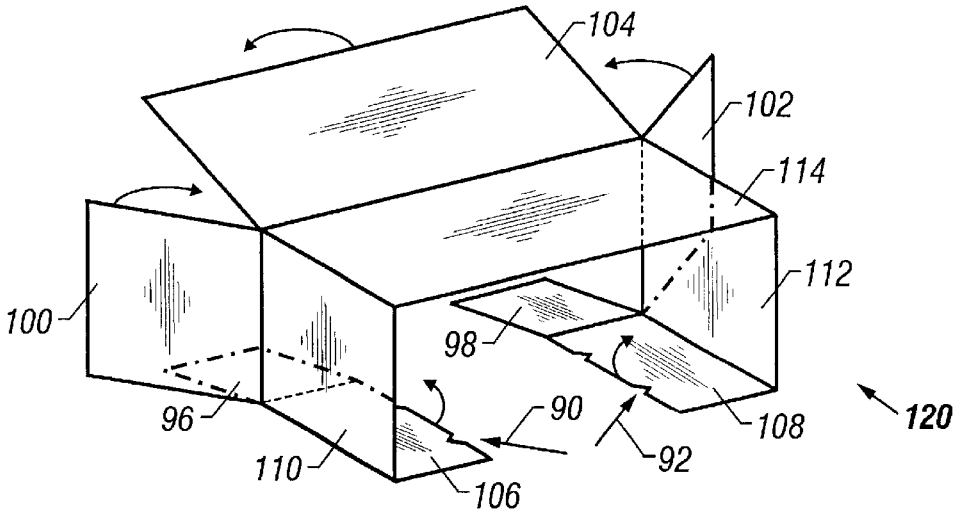
FIG. 8 is a elevated isometric view of the plastic sheet of FIG. 7 configured into an end cap according to the present invention.

Referring now to FIG. 8, the rear-end cap 120, formed from the section 80 of FIG. 7, illustrates the bottom edges 106 and 108, and the bottom flaps 96 and 98. The bottom flaps 96 and 98 are folded up first, then the side flaps 100 and 102 are folded in, followed by the top flap 104 being folded down last. The rear-end cap, as thus formed, is then placed on the floor, at the end of the floor distal from the end 20 of the container in FIG. 1.

Figure 9A:
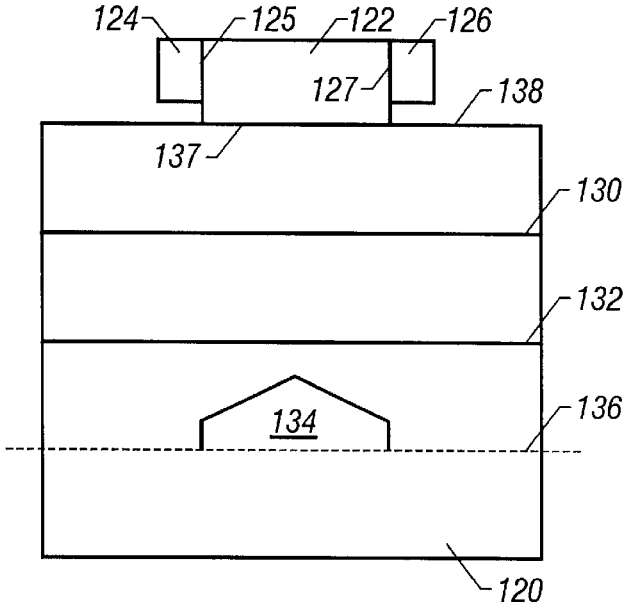
FIG. 9 is a plan view of a sheet of plastic material used in accord with the present invention to form a triangular support.
Figure 9B:
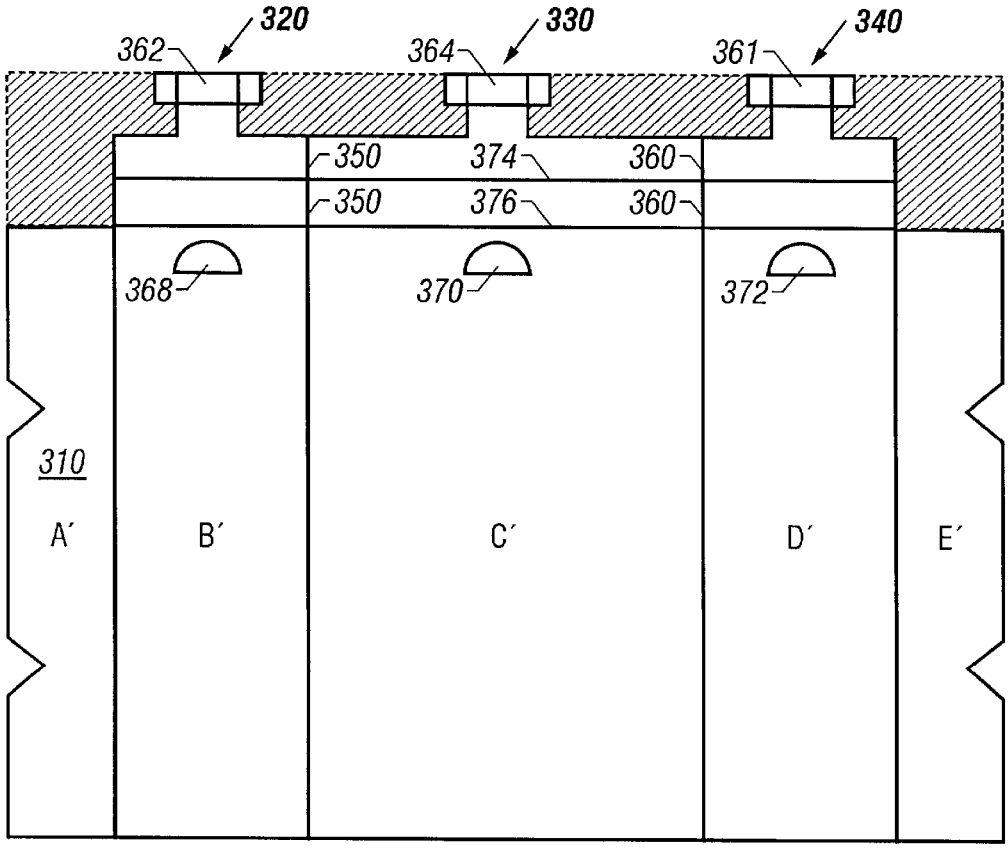

Referring now to FIG. 9, there is illustrated, diagrammatically, a flat sheet of COROPLAST material 121, merely for demonstrating the process for building a triangular support. The section 121 is actually the same as section C in FIG. 6. Integral with the sheet 121 is a projection 122 having a pair of ear flaps 124 and 126 resulting from the score lines 125 and 127, respectively. The sheet 121 also has transverse score lines 130, 132 and 137.

An opening 134 is formed in the sheet 121 sized to receive the projection 122. The distance from the end line 138 of the sheet 121 to the score line 130 is the same as the distance between score lines 130 and 132, and as the distance between the score line 132 and the dotted line 136, the line 136 being indicative of the lower side of the opening 134.

By bending in the ear flaps 124 and 126 at the score lines 125 and 127, respectively, and by bending the sheet 121 at score lines 130, 132 and 137, the projection 122 can be placed through the opening 134, thus forming an equilateral triangular support. By unfolding the ear flaps 124 and 126 until they are coplanar with the projection 122 on the underneath side of the sheet 121, the thus-formed equilateral triangular support provides stability to the overall system while the inner flexible tank 30 is being filled with the material to be transported.

In the actual process of the present invention, the triangular support is provided, as illustrated in FIG. 9A, not only for the width of section C of FIG. 6, but also along the external sides of Sections B and D of FIG. 6, with the formation of the triangular support being identical to the formation of the triangular support for Section C. It should be appreciated that the embodiment of FIGS. 5 and 6 provide no triangular support, while FIG. 9A provides the three-sided, triangular support and Sections A, B, C, D and E of FIGS. 5 and 6 otherwise correspond to Sections $A^1$, $B^1$, $C^1$, $D^1$ and $E^1$ of FIG. 9A.

By commencing with a rectangular sheet 310 of COROPLAST material as illustrated in FIG. 9A, and cutting away the areas shown in cross-hatch, there remains the bases for three triangular supports 320, 330 and 340, each of which is formed with the same process as described in FIG. 9. By cutting along the lines 350 and 360, the three projections 362, 364 and 366 can be manipulated independently of each other, and can be inserted through the openings 368, 370 and 372, respectively, to complete each of the three triangular supports.

The system contemplates the use of nine support bands just like the embodiment of FIG. 9A, except two of them have their apex pointed downwardly, while the other seven have their apex pointed upwardly. To formulate the triangular support with the apex down, the COROPLAST material is hinged down, instead of up, along the score lines 374 and 376, and the projections 362, 364 and 366 pushed through the openings 368, 370 and 372, respectively. Because of the nature of the scoring process, which crushes the COROPLAST material all the way from one side to the other, the material can be bent along the score lines quite easily in either direction.

Figure 10:
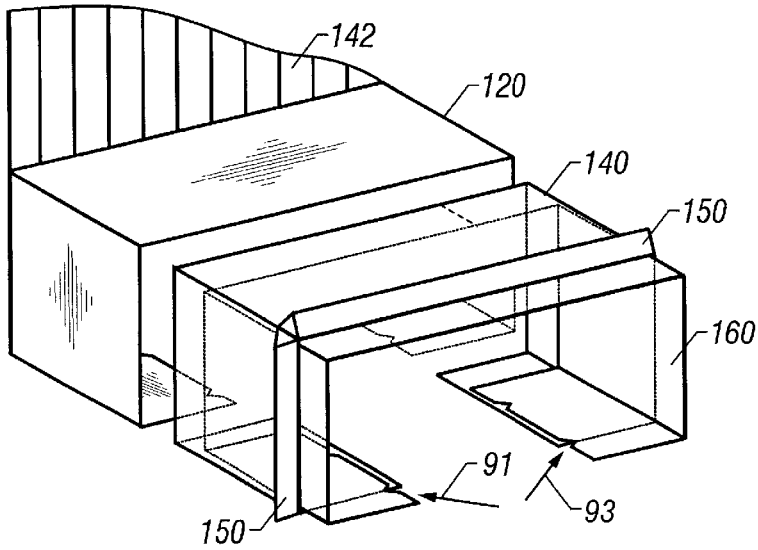
FIG. 10 is an elevated isometric view of the joining together process of the rear end cap and a support band according to the present invention.

The bottom flaps 90 and 92 of end cap 120 in FIG. 8 has a pair of v-shaped notches 90 and 92. After the rear-end cap 120 is placed at the rear wall 142 of the container 10, i.e., at the end of the container distal from the two doors 24 and 26, the first of nine of the support bands, designated as band 140, which could be like the support band of FIG. 6, but which preferably is like the support bands having the triangular supports, is installed over the rear-end cap 120 as illustrated in FIG. 10. The band 140 is slid over the outside of the rear-end cap 120 until the alignment notches 90 and 92 of the end cap are aligned with the first to enter alignment notches 53 and 55, respectively, of the support band 140 (identical to support band 60 other than having the triangular supports). The triangular support illustrated in FIG. 9 is illustrated as support 150 running along the entire of its section C and along the entire height of Sections B and D.

Figure 11:
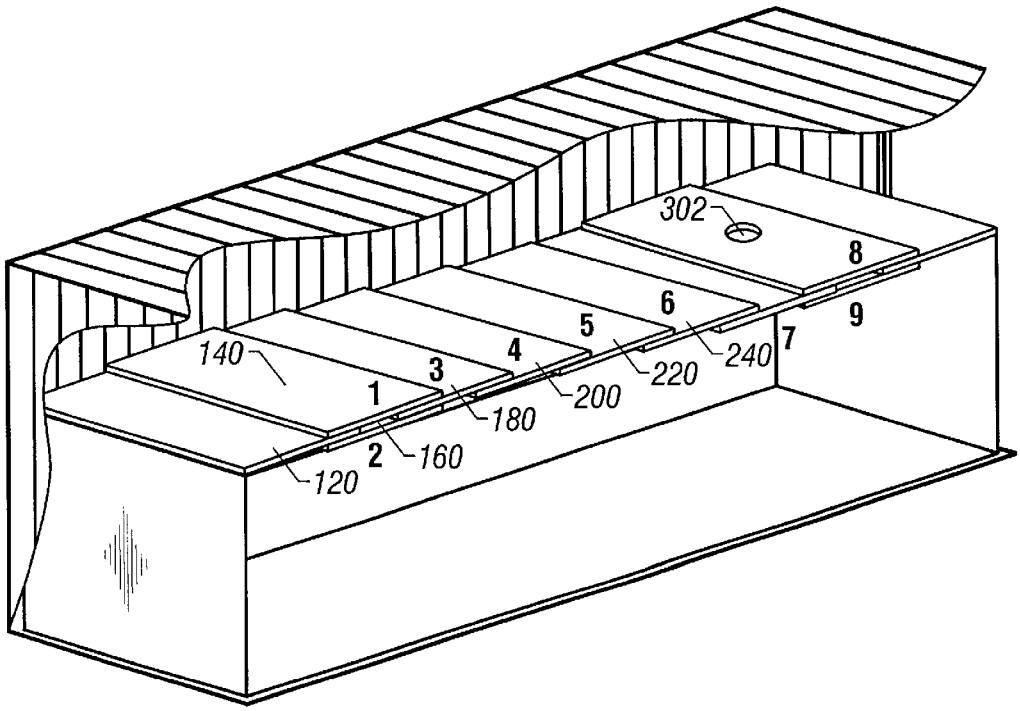
FIG. 11 is an elevated, diagrammatic, isometric view of the overall assembly of two end caps and the plurality of support bands therebetween, in accord with the present invention.

A second support band 160, having its triangular supports installed, with its triangular apex pointed downwardly, is slid inside both the rear-end cap 120 and the support band 140 as illustrated in FIG. 11, at which point the bands 140 and 160 are directly one above the other. Each of the nine support bands has two pairs of v-shaped notches as illustrated in FIG. 6, while the end caps each has only a single pair of v-shaped notches 90 and 92, as illustrated in FIG. 8. If all four v-shaped notches are aligned between adjacent support bands, then such adjacent bands are one over the other. If only two v-shaped notches are aligned, than adjacent bands overlap.

A third support band 180, having its triangular support mounted with its apex pointing up, is then slid in between support bands 140 and 160 as illustrated in FIG. 11 until two alignment notches of each of the two bands 160 and 180 are aligned, such alignment providing an overlap between bands 160 and 180.

The fourth, fifth, sixth and seventh support bands, designated respectively, as support bands 200, 220,240 and 260, having their triangular apices pointed up, are installed by sliding the fourth inside the third, the fifth inside the fourth, the sixth support band inside the fifth support band, and the seventh inside the sixth, as illustrated in FIG. 11, each time sliding the next band back until their respective closest alignment notches are aligned.

Figure 12:
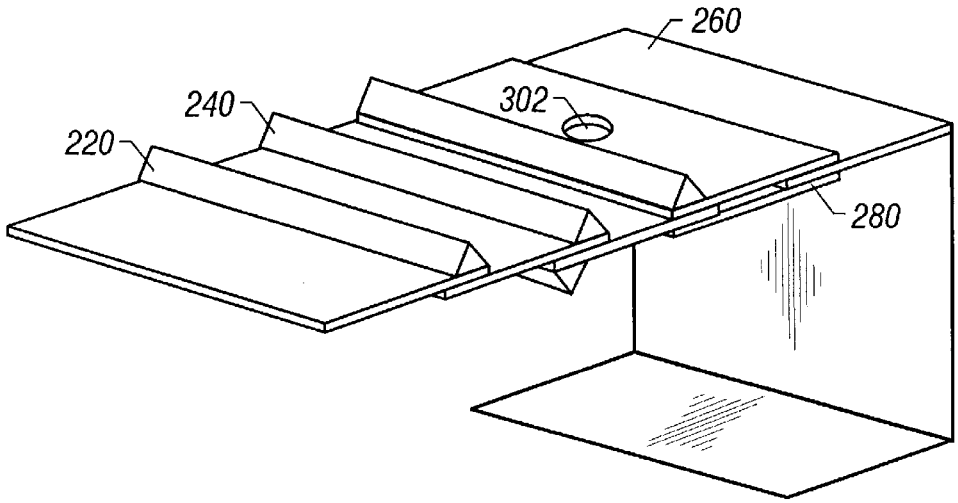
FIG. 12 is an elevated isometric view of the joining together process of the door end cap and a support band according to the present invention.

FIG. 12 illustrates the installation of the eighth support band 265 which slides over the seventh support band 260. A ninth support band 267, with the apex of its triangular support pointed down, is placed inside the seventh support band 260, with bands 265 and 267 being exactly aligned, i.e., no overlap, just as support bands 140 and 160 are aligned. The door end cap 300, just like the rear-end cap 120, has its leading edge inserted between the support bands 265 and 267. A load/discharge port 302 is formed through the support bands 265 and 267.

Figure 13:
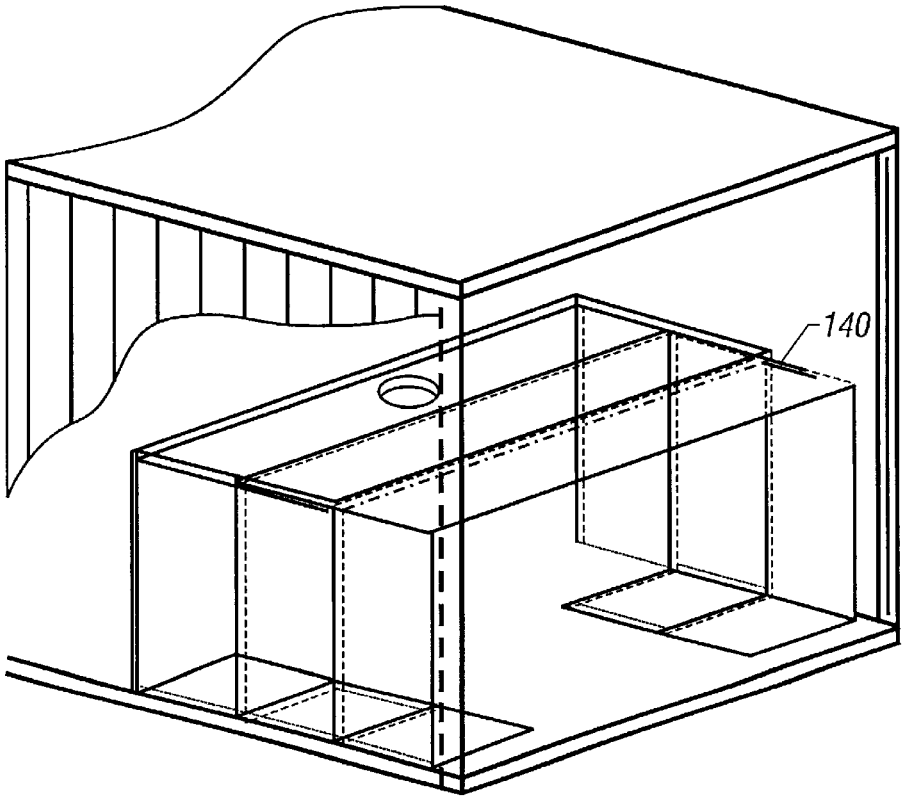
FIG. 13 is an elevated isometric view of the assembly process used in configuring the door end cap.

To install the front end cap, i.e., the one next to the doors, FIG. 13 indicates that the end cap 300 is assembled with its bottom flaps 106 and 108 open, and can be cut off if desired. The rear edge of the end cap 300 is inserted between the eighth and ninth support bands 265 and 267. The front edge of the end cap 300 is aligned with the rear edge of the door recess (not illustrated) typically provided on the 20-foot container 10.

Once all of the nine support bands have been installed to each other and to the two end caps, a floor lining is installed, using a sheet of the COROPLAST material which is approximately 22 feet long and approximately 7 feet wide to ensure that the gap between the two ends of each of the support bands is adequately covered. The length of the floor lining is a foot or two longer than the interior of the container 10 to allow the opposing ends of the floor lining to be turned up, which could, of course, be done on each of the side walls of the container 10 if desired.

Once the floor lining is in place, which can be put down in more than one piece if desired, the flexible inner tank 30 is rolled out onto the floor lining, or onto the optional heat exchanger pad illustrated in FIG. 4 if desired. The hose fittings, not illustrated, can then be hooked up to the fill port in the flexible tank 30, and the liquid, near liquid, or dry particulate matter can start to be added to the interior of the tank 30.

The left-hand door of the container 10 is always left closed and locked during the loading or unloading operation. Because of bulkhead support bars being across the door opening, the right-hand door can be opened to better observe the operations. Because both the flexible inner tank and the COROPLAST material liner are translucent, an operator can easily monitor the level of the material in the flexible inner tank as it is being loaded or unloaded. As an assist in that regard, a sight gauge can be provided through the bulkhead.

As the material, for example, a liquid such as corn oil, is first being loaded, the triangular support members provide a fair amount of integrity to the structure of the COROPLAST material support bands. As the inner tank starts to fill, the material causes the inner tank to push against the top of the support bands until finally the support bands take on a slightly outward bow, providing a clearly visible indication that the inner tank is filled to capacity. As the material is added to the flexible inner tank, the seven external triangular supports and the two internal triangular supports frequently will flatten completely out, but causing no problem by flattening out, since they are only helpful in keeping the COROPLAST material liner in shape until the material is added to the flexible inner tank.

In addition, by causing a slight bow to the liner, and thus pre-stressing the COROPLAST material liner, it is believed that the liner will be less subject to additional deformation, providing a substantial improvement to the art of shipping bulk materials.

Moreover, while the preferred embodiment contemplates using the COROPLAST material as the support bands, the invention is not limited to using the COROPLAST material. By using overlapping plastic materials in general, in such a manner that the flexible inner liner "sits" on the two ends of each support band, the weight of the quite heavy, product-filled flexible liner on the ends of the support bands causes the plastic outer liner to be snugly formed about the perimeter of the inner liner.

It should be appreciated that the present invention is not limited to shipping liquids, but can be used to transport any pumpable material, including dry, granulated or particulate matter, and can also be used to transport semi-liquid materials such as partially frozen orange juice, i.e., a product sometimes referred to as being "slushy", or other partially frozen juices or liquids.

Orange juice is typically transported in refrigerated trucks, designated in the trade as "reefers". The typical refrigerated truck has no recess around the doors for holding or supporting the bulkhead needed to support the filled flexible tank 30. Moreover, the typical refrigerated truck has its refrigeration unit at the end of the truck, next to the driver's cab, i.e., at the end of the truck away from the doors. Because the flexible tank 30 and the COROPLAST or other plastic end cap must be kept away from directly contacting the refrigeration unit, a need exists for a bulkhead at both ends of the flexible tank 30, against which the COROPLAST end sheets can reside.

Figure 14:
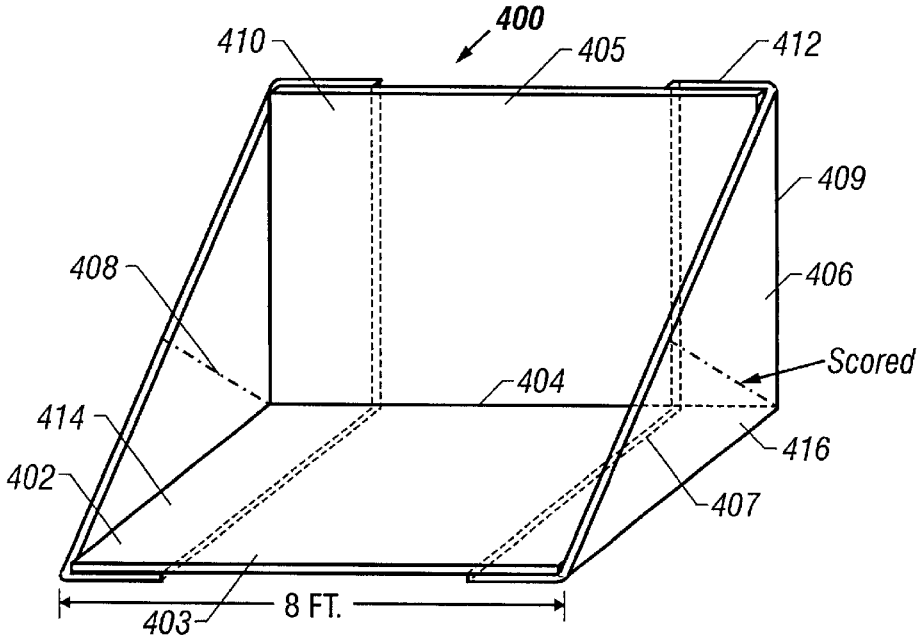
FIG. 14 is an elevated isometric view of plastic sheets configured into a stand-alone bulkhead according to the present invention.

FIG. 14 illustrates a plurality of COROPLAST sheets which together can be configured to form a stand-alone bulkhead against which either the door cap or the rear end cap can reside.

In FIG. 14, the stand alone bulkhead 400 is fabricated by using a first sheet 402 of COROPLAST material which is scored along the line 404 which enables the first section 403 of the material 402 to be bend at an angle of 90 degrees from the portion 405. A second sheet of COROPLAST material 406 is scored along the lines 407,408, and 409 and is bent to confirm with the shape illustrated in FIG. 14. In fabricating the device as illustrated in FIG. 14, the wings 410 and 412, as well as the wings 414 and 416 are heat welded to the sheet 405 and the sheet 403, respectively to form the configuration illustrated in FIG. 14.

Figure 15:
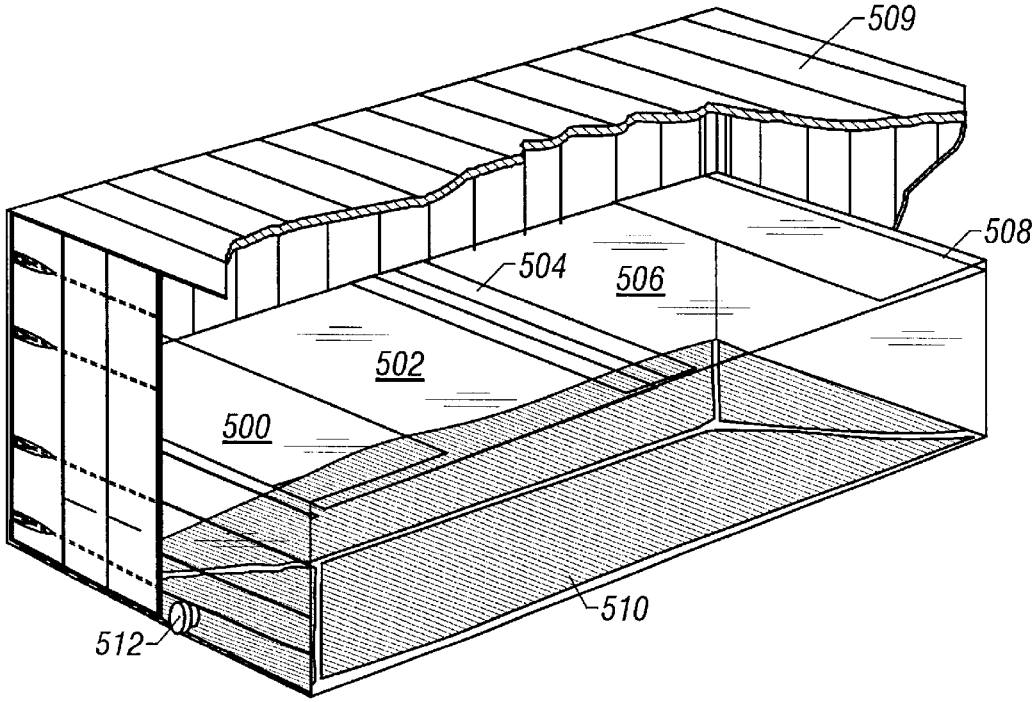
FIG. 15 is an isometric, partially cut away view of an alternative embodiment of the present invention.

In the operation of the bulkhead 400 illustrated in FIG. 14, it should be appreciated that such a bulkhead can be used at one or both ends of the embodiments of the present invention illustrated in FIG. 11 and in FIG. 15 in accordance with the present invention.

Referring now to FIG. 15, there is illustrated an alternative embodiment of the present invention which uses a lesser number of support bands than those which are illustrated in FIG. 11. In FIG. 15, there is illustrated a door end cap 500, a first support band 502, a second support band 504, a third support band 506, and an end cap 508, all of which are illustrated as being within a 20' shipping container 509 and having an inner liner bag 510. The inner liner bag 510 has a port 512, described in more detail hereinafter, which is used for loading and unloading the inner liner bag 510.

Figure 16:
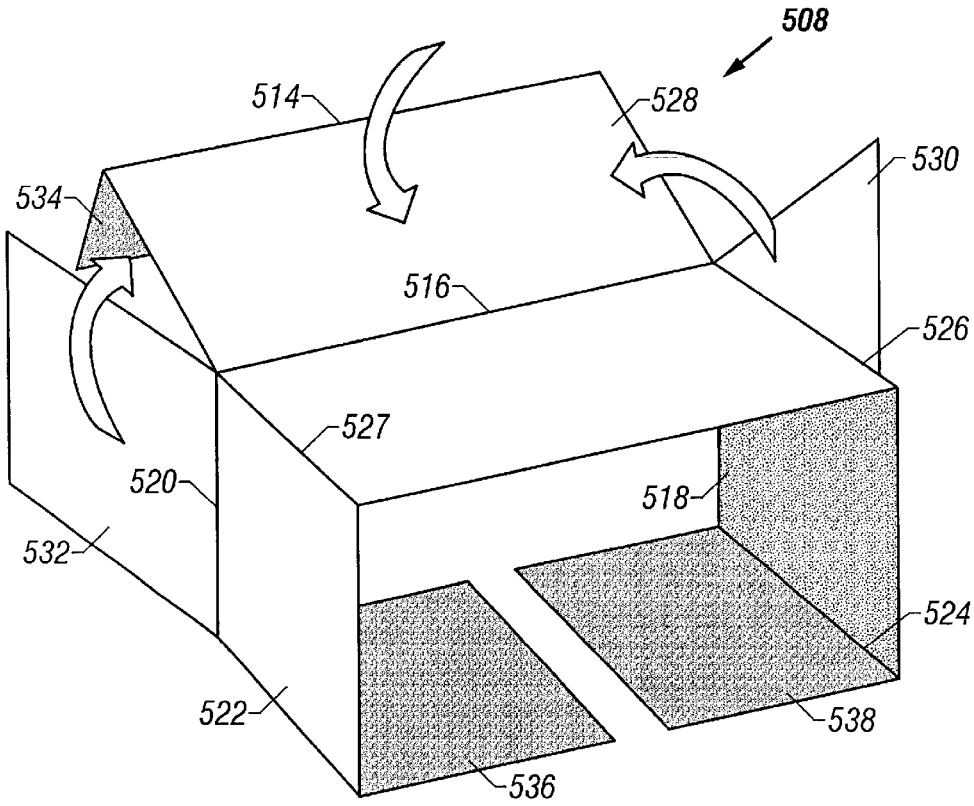
FIG. 16 is an isometric view of the rear end cap of the alternative embodiment illustrated in FIG. 15.

Referring now to FIG. 16, the rear end cap 508 is described in greater detail. The rear end cap 508 is fabricated from the COROPLAST material from a single sheet of such material and is scored along its lines 514, 516, 518, 520, 522, 524, 526, and 527. In using the rear end cap illustrated in FIG. 16, the flap 528 is first folded down, followed by the flap 530 being folded in and then the flap 532 being folded in. By folding in the flap 528 first, the inside liner bag (not illustrated in FIG. 16) will have a smooth surface against which to rest. In sharp contrast, if the flaps 530 and 532 were first folded in, the inside liner bag would have a rough surface because of the leading edges of the flaps 530 and 532 against which to rest. When the flap 528 is folded down, the wing 534 is inserted under the end cap feet 536 and 538.

Figure 17:
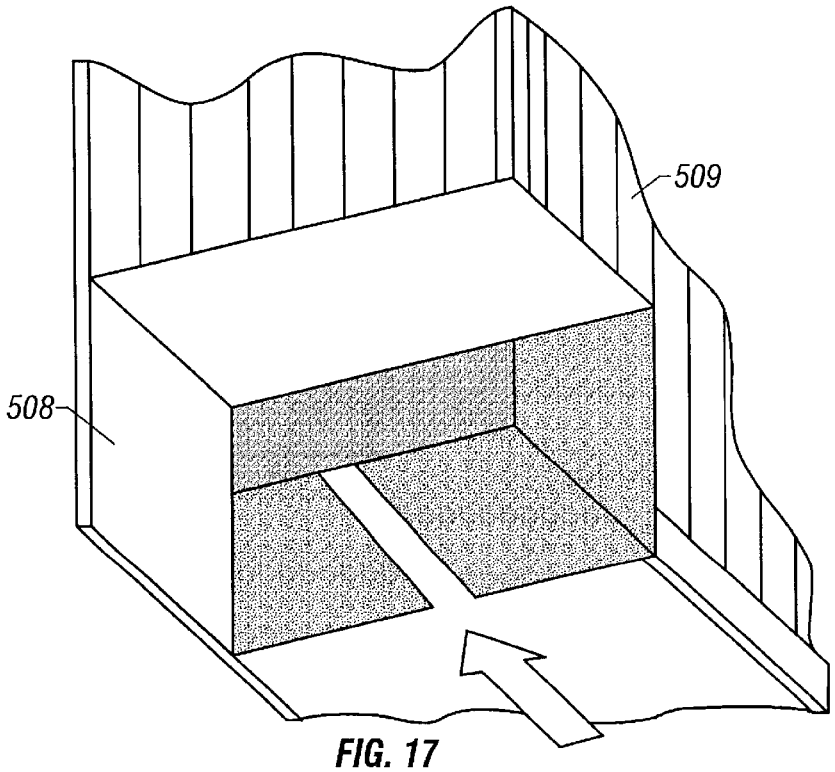
FIG. 17 is an isometric view of the rear end cap illustrated in FIG. 16 in its folded position after being slided back to the rear end of the still container.

Referring now to FIG. 17, the rear end cap 508 is illustrated as being slided down to the rear of the steel container 509.

Figure 18:
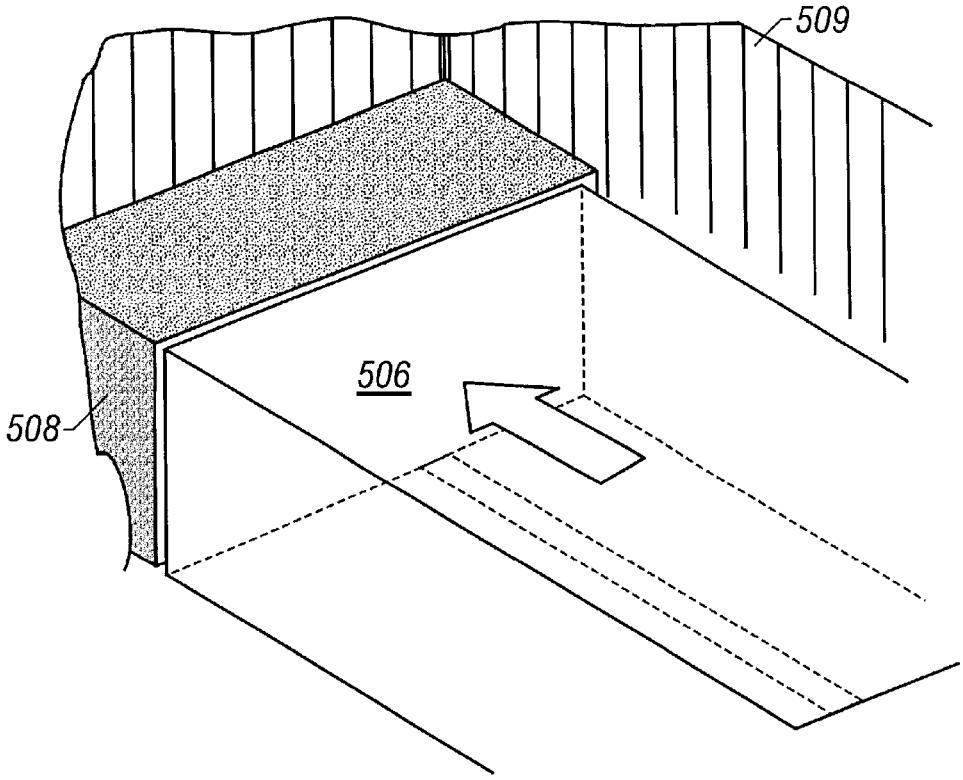
FIG. 18 is an isometric view of a first support band which has been slided back within the interior of the rear end cap illustrated in FIGS. 16 and 17.

Referring now to FIG. 18, with the rear end cap 508 being in place against the rear wall of the container 509, a third support band 506 is illustrated as being telescoped within the interior of the end cap 508. It should be appreciated the third support band 506 is also fabricated from a sheet of the COROPLAST material.

Figure 19:
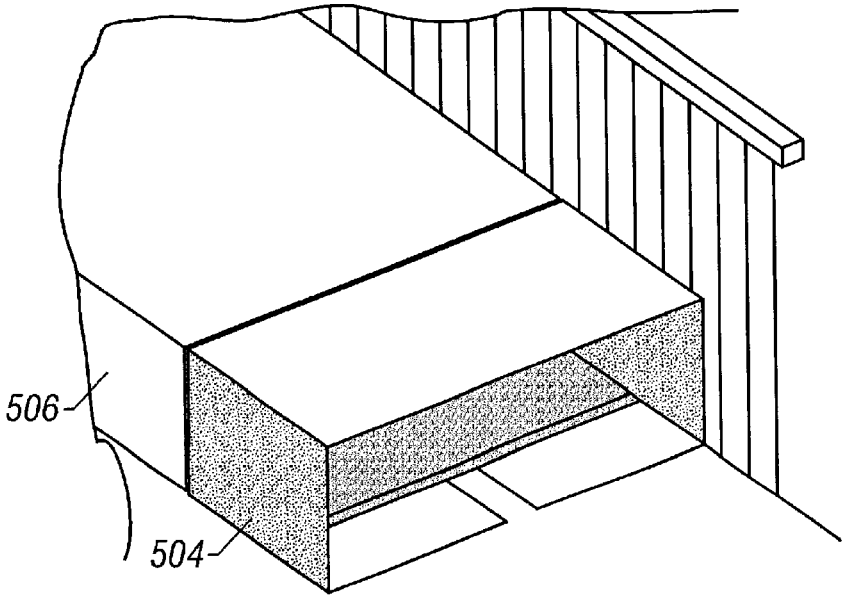
FIG. 19 is an isometric view of a second support band which has been slided back over the outer end of the first band support band illustrated in FIG. 18.

FIG. 19 illustrates a second support band 504, also fabricated from a sheet of the COROPLAST material within which the third support band 506 is telescoped inwardly.

Figure 20:
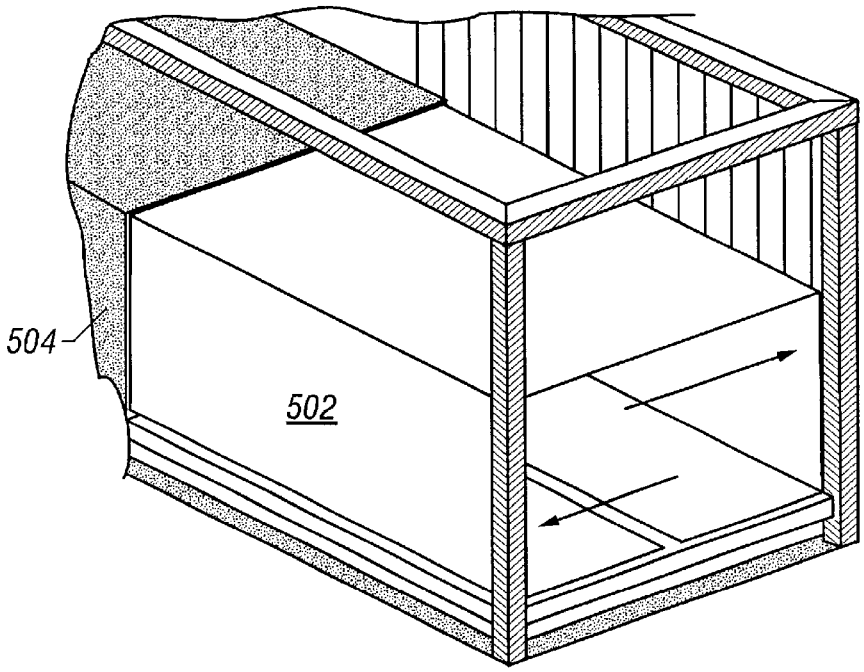
FIG. 20 is an isometric view of a third support band which has been slided back inside the second support band illustrated in FIG. 19.

FIG. 20 illustrates a first support band 502, also fabricated from a sheet of the COROPLAST material, which is telescoped inwardly within the second support band 504.

Figure 21:
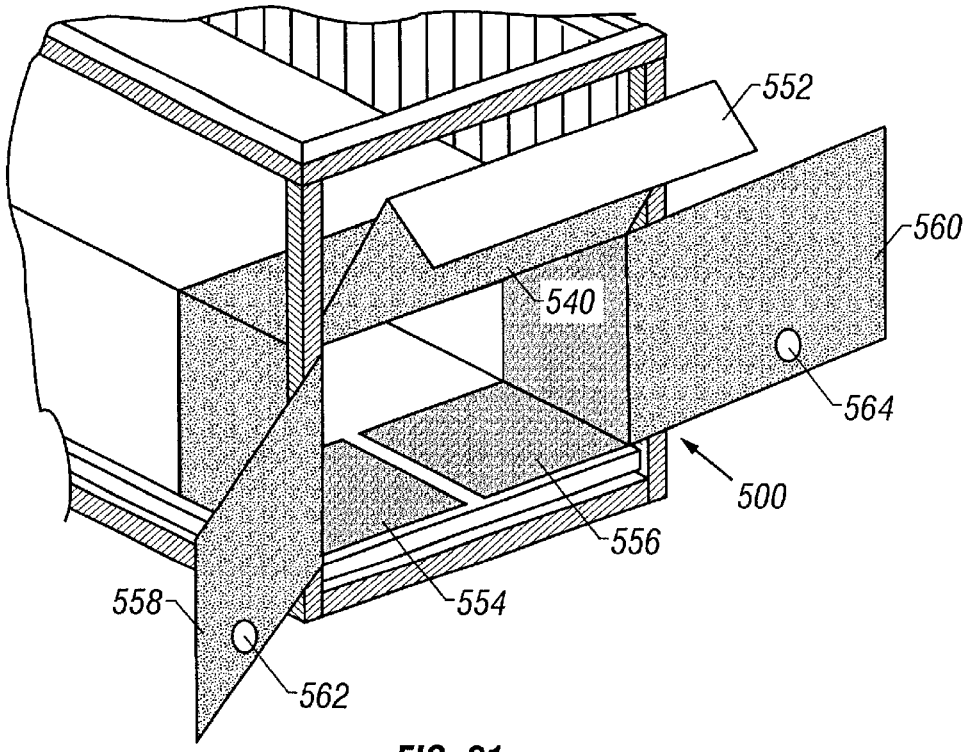

Referring now to FIG. 21, the door end cap 500 which first has its top flap 540 in a position to be folded down, in particular, its wing 552 under the feet 554 and 556. After the wing 552 is in place under the feet 554 and 556, the wings 558 and 560 are folded in. It should be appreciated that the wings 558 and 560 have ports 562 and 564, respectively, for allowing access between the fill/discharge port from the inner liner and the exterior of the apparatus illustrated in FIG. 21.

Figure 22A:
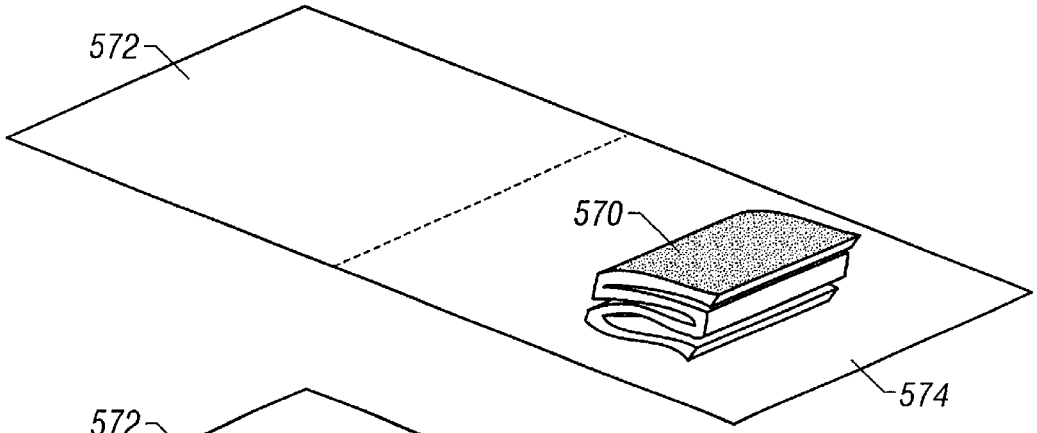
FIGS. 22*a–c* shematically illustrates an inter liner bag which is shown sequentially as being folded up on two piece floor covering within the steel container and which is an unrolled in its position ready to receive materials within its loading port.
Figure 22B:
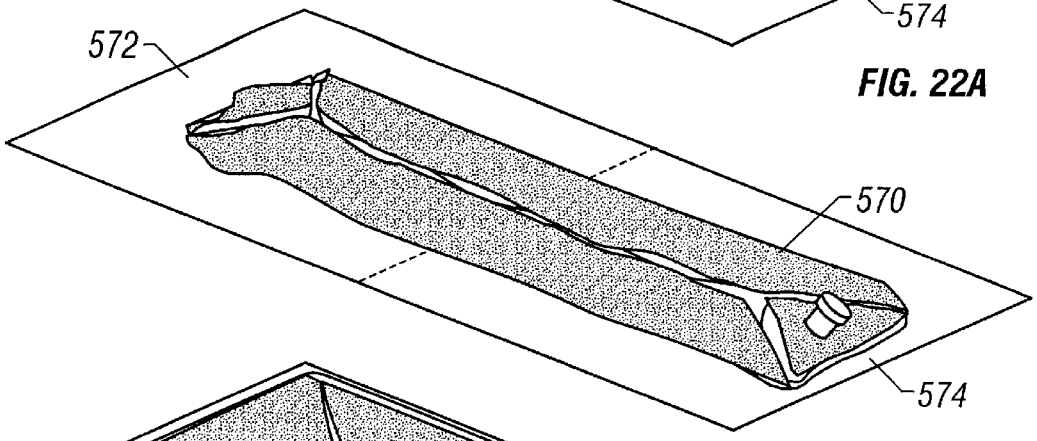
Figure 22C:
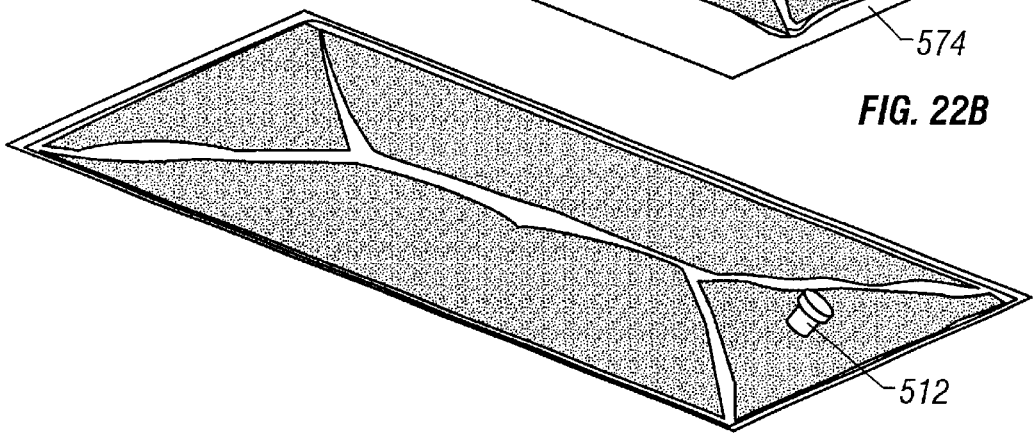

FIG. 22 illustrates the manner in which the inner liner bag 57, is placed on the two piece floor covering 572 and 574 in preparation for use of the inner liner bag 570 within the apparatus according to the present invention. After the inner liner bag 570 is unrolled, as illustrated in FIG. 22B and in FIG. 22C, the inner liner bag 570 is in a position to be filled through the fill/discharge with the product being shipped.

Figure 23:
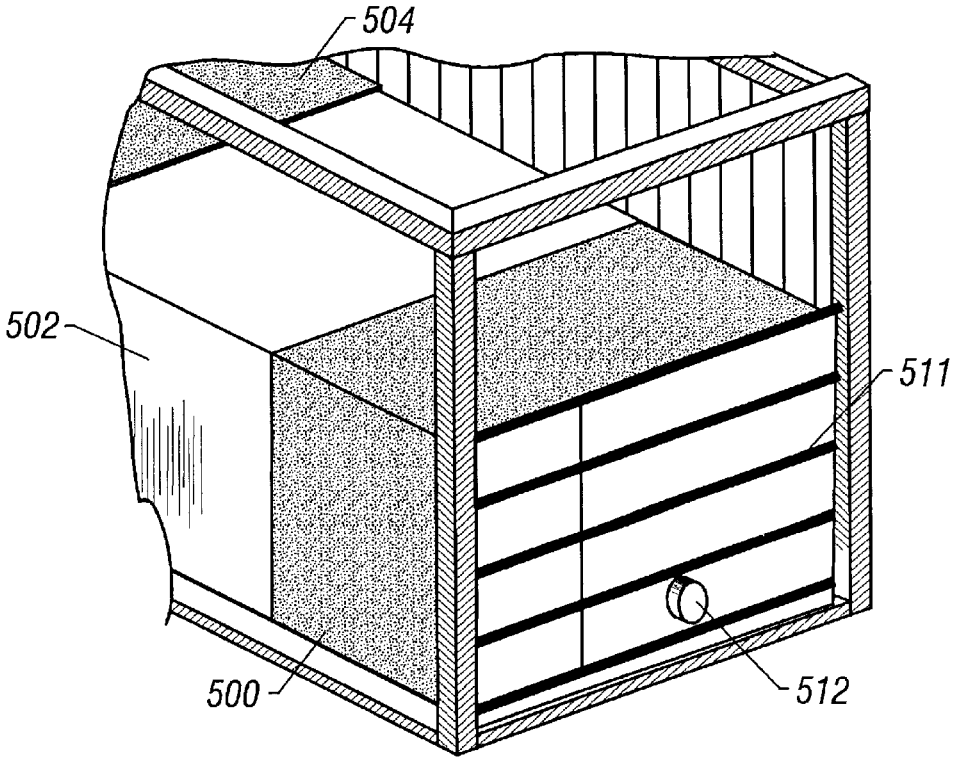
FIG. 23 is an isometric view illustrating the second and third support bands in the door end cap which has its fill/discharge port in a position ready for either filling or discharging the materials within the inner liner.

Referring now to FIG. 23, the second support band 504, the first support band 502 and the door end cap 500 are illustrated in place against the support doors 511 at the entrance of the container 509 adjacent to the doors of the container (not illustrated). The fill/discharge fitting 512 is illustrated as passing through the end of the door end cap 500.

Figure 24:
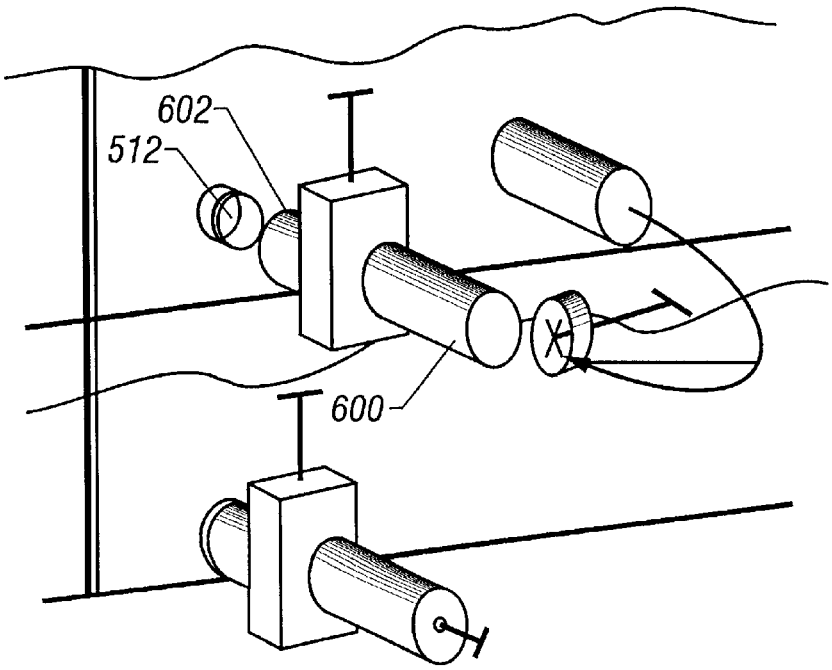
FIG. 24 illustrates one type of discharge tool which can be used to discharge materials from the fill and discharge port illustrated in FIG. 23.

Referring now to FIG. 24, the fill/discharge port 512 is illustrated as passing through door end cap 500. Pipe 602 is inserted within the pipe chamber 600 to open an internal check valve within the discharge or loading port 512.

Figure 25A:
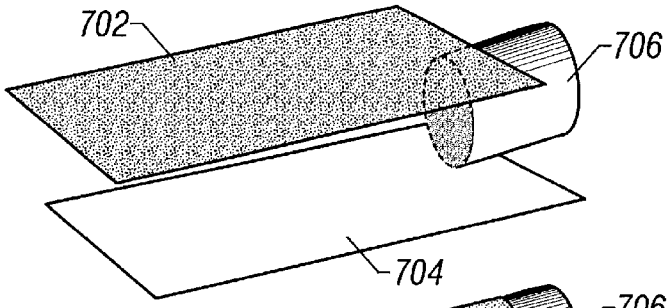
FIGS. 25*a–c* illustrates an alternative embodiment of a duck bill type fill and discharge port which can be used in accordance with the present invention.
Figure 25B:
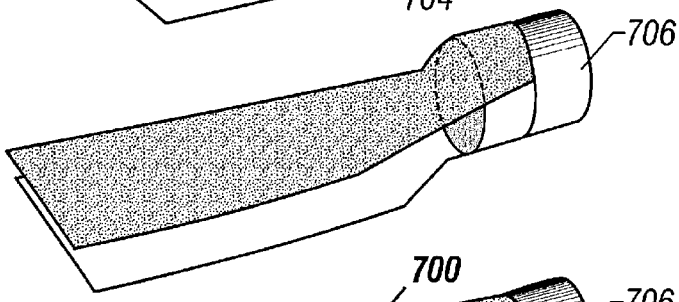
Figure 25C:
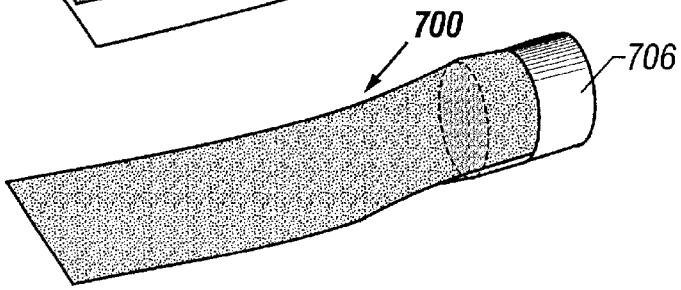

FIG. 25 illustrates an alternative embodiment of the present invention, one which is preferred and that involves the use of a duck bill valve 700 connected to the port 512 which involves the use of two 20 mil polyethylene sheets 702 and 704 which are heat welded together at their edges as illustrated in FIG. 25C. The polyethylene sheet 702 and 704 are also heat welded to a fitting 706 which can be fitted over the fitting 512. To utilize the apparatus illustrated in FIG. 25 to load the inner liner, is only necessary to inject a probe through the sheets 702 and 704 within the fitting 706 which enables a one way check valve within the fitting 512 to be opened and the material to be loaded through the fitting 706 and the fitting 512. When it is desired to discharge the inner liner, the same probe is inserted within the polyethylene sheets 702 and 704 to open the one way check valve allow the material to be released from the inner liner.

Duck bill check valves are known in the prior art and, if desired, can be manufactured in accord with the disclosure of U.S. Pat. No. 4,607,663 to SG Raftis et al.

Figure 26:
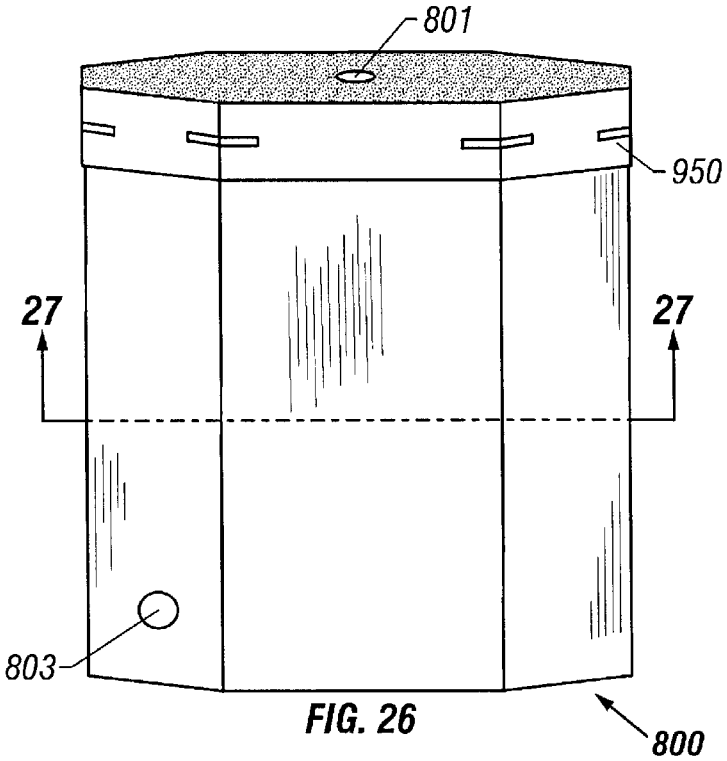
FIG. 26 illustrates an isometric view of an inter mediate bulk container in accordance with the present invention.
Figure 27A:
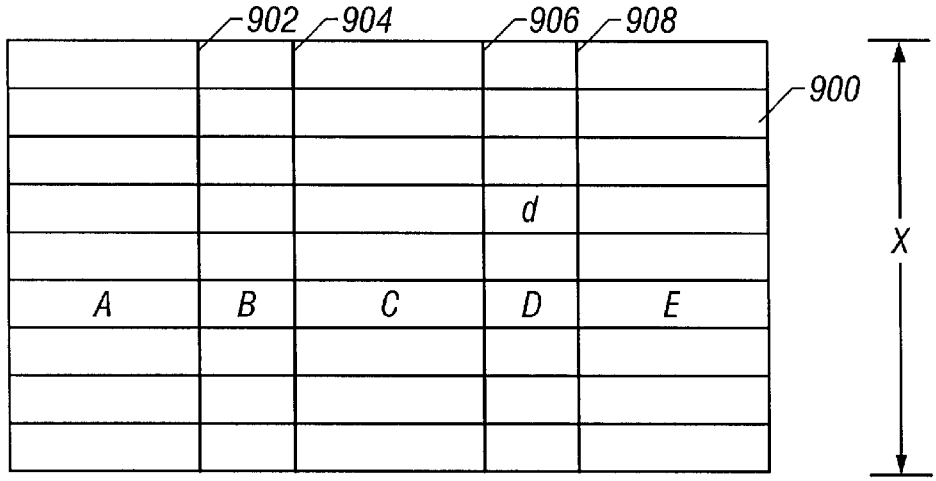
FIGS. 27*a–c* illustrates, graphically, the manner in which the sidewalls of the apparatus of FIG. 26 are fabricated.
Figure 27B:
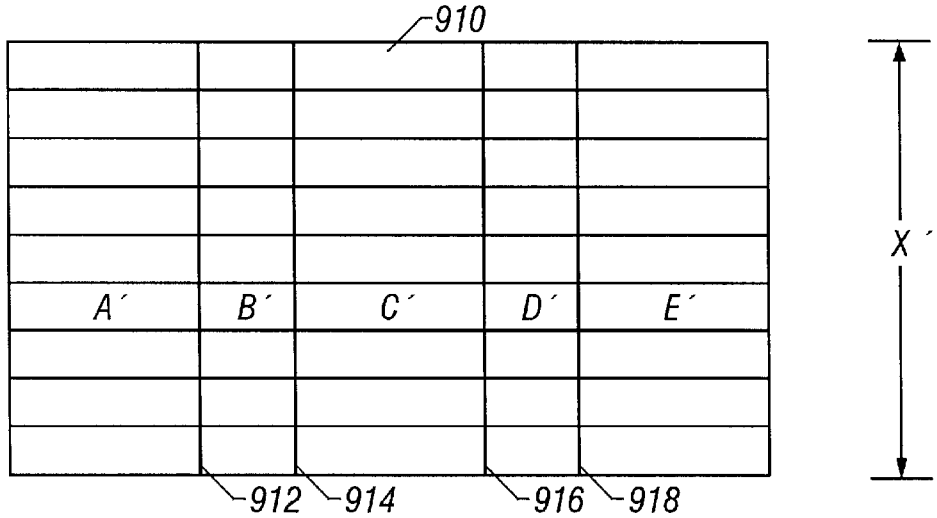
Figure 27C:
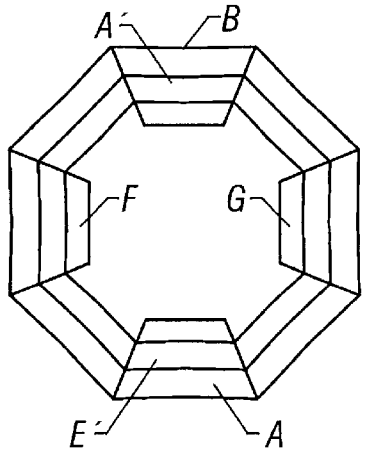

Referring now to FIG. 26, there is illustrated an alternative embodiment of the present invention, in which there is illustrated an intermediate bulk container, sometimes referred to as an IBC in this industry, the IBC unit of FIG. 26 being designated generally by the numeral 800. While the IBC unit 800 illustrated in FIG. 26 can be made to hold various volumes of materials, the preferred embodiment contemplates the IBC unit 800 will hold 240 gallons of fluid, or the dry product equivalent thereof. The IBC unit 800 is designed to fit upon a conventional grocery style pallet which is 44 inches by 44 inches square. As is illustrated in FIG. 27, in more detail, the IBC unit 800 is octagonally shaped, i.e., having eight sides which alternate between being 20 inches wide and 18 inches wide. The IBC unit 800 in the preferred embodiment is 40 inches tall. The IBC unit 800 has an input port 801 into which the materials can be pumped in at an exit port 803 from which the materials can be pumped out of the IBC unit 800.

Referring now to FIG. 27(*a*), there is illustrated a sheet of COROPLAST material 900, sheet 900 having a width X, and being scored along the lines 902, 904, 906 and 908, resulting in the panels identified by the letters A, B, C, D and E. In this preferred embodiment, the width dimension X is preferably 40 inches and the panels A, B, C, D and E are preferably 20 inches, 18 inches, 20 inches, 18 inches and 20 inches, respectively.

In FIG. 27(*b*), a second sheet of COROPLAST material 910 having a width $x^1$ and being scored along the lines 912, 914, 916 and 918, results in the panels $A^1$, $B^1$, $C^1$, $D^1$ and $E^1$. All of the dimensions of the sheet of COROPLAST material 910 correspond identically to the sheet of material 900 and the panels $A^1$, $B^1$, $C^1$, $D^1$ and $E^1$ correspond to the dimensions of the panels A, B, C, D and E illustrated in FIG. 27(*a*).

In order to fabricate the embodiment of FIG. 27(*c*), the panel E of the sheet 900 is placed over the panel $A^1$ of the sheet 910 where the two are heat welded together. The panel A of sheet 900 is placed over the panel $E^1$ of the sheet 910 and they are also heat welded together to complete the octagonal shape illustrated in FIG. 27(*c*). The configuration is sometimes referred to in the embodiments of FIG. 30 described hereinafter as being the outer sleeve.

Figure 30:
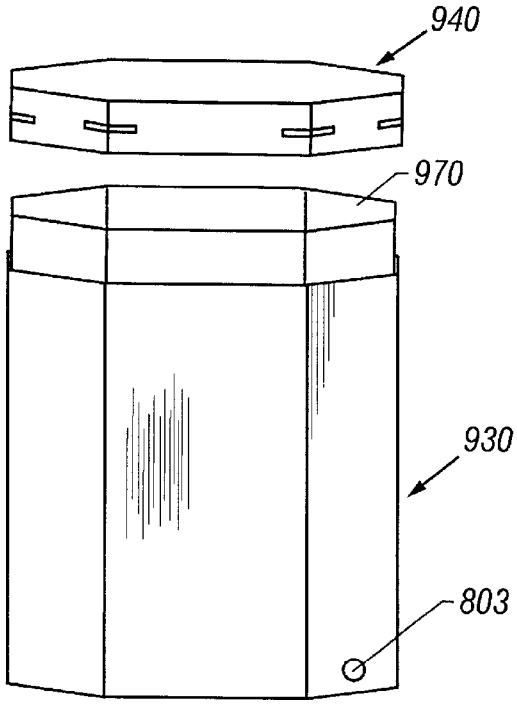
FIG. 30 illustrates the additional steps involved in the assembly of the apparatus of FIG. 26.

In the same manner, a second pair of COROPLAST sheets (not illustrated) are fabricated corresponding to the sheets 900 and 910 to form an inner sleeve which is also illustrated in FIG. 30. If desired, the sheets which form the inner sleeve can use panels which are only slightly smaller than the panels illustrated in FIG. 27 but that is not absolutely necessary because of the tendency of the COROPLAST materials to have some flexibility.

It should be appreciated that before the inner sleeve is inserted within the outer sleeve, both illustrated in FIG. 30, that the outer sleeve has two sections which are double wall thickness, viz, E and $A^1$ being one such double wall thickness and A and $E^1$ being a second double wall thickness, and being 180° apart.

When the inner sleeve is inserted within the outer sleeve, the inner sleeve is rotated to be within the interior of the outer sleeve and has two such double wall thickness portions F and G which are 180° apart but which have been rotated 90° such that the section F is 90° apart from either of the double wall sections of the outer sleeve and section G is also 90° apart from the double wall sections of the outer sleeve. As an end result, as illustrated in FIG. 27(*c*), there is resulted four triple wall sections, rotated 90° each around the periphery of the octagonal shape of FIG. 27(*c*), resulting in an octagonal shaped container having a totally unexpectedly strong mechanical configuration. Also as illustrated in FIG. 27(*c*), because of the way the inner sleeve is rotated with respect to the outer sleeve, alternating between each pair of the triple wall sections is a double wall configuration.

Figure 28:
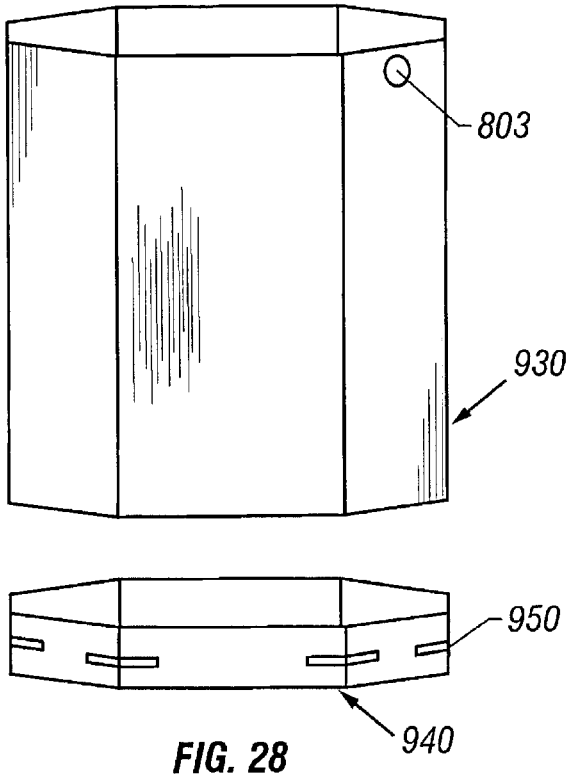
FIG. 28 illustrates an isometric view of the apparatus of FIG. 26 showing how the apparatus is partially assembled.

Referring now to FIG. 28, to assemble the container of FIG. 27, the outer sleeve 930, having the two sheets of COROPLAST material 900 and 910 heat welded together as contemplated by the description above with respect to FIGS. 27(*a*), (*b*) and (*c*), is placed within the COROPLAST lid 940 which has previously been placed on the floor. The lid 940 is fabricated from a single sheet of COROPLAST material which is quoted along the lines which enable it to be folded into the configuration illustrated in FIG. 28. Before inserting the outer sleeve into the lid, the outer sleeve is folded inwardly and then snapped in place within the lid 940. As illustrated in FIG. 28, the discharge port 803 is in the upper most position while inserting the outer sleeve into the lid 940. The lid 940 has a band of material 950 threaded through its side walls which can be used with a turn buckle or other tightening device as discussed hereinafter.

Figure 29:
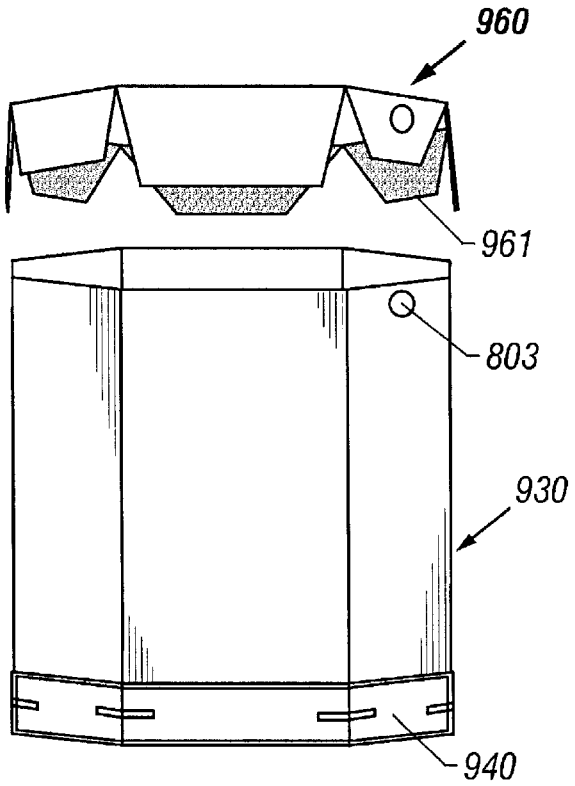
FIG. 29 is an isometric view of additional steps involved in assembling the apparatus of FIG. 26.

Referring now to FIG. 29, the bottom 960, also fabricated from a single sheet of COROPLAST material, and scored along the lines necessary to take the embodiment as illustrated in FIG. 29, is inserted within the outer sleeve 930 while the unit of FIG. 28 is still in the inverted position.

Referring now to FIG. 30, the container is returned to the upright position and the lid is removed. The inner sleeve 970, fabricated in accord with the teachings and disclosure of FIG. 27, and being rotated 90° from the configuration of the outer sleeve, is inserted within the interior of the outer sleeve and has its discharge port aligned with the discharged port through the outer sleeve, shown generally as numeral 803. It should be appreciated that because the discharge port of the outer sleeve must be aligned with the discharge port of the inner sleeve, and because the inner sleeve is rotated 90° with respect to the outer sleeve, the discharge port of the inner sleeve is also fabricated within the inner sleeve 90° from the location of the discharge port and the outer sleeve.

Prior to inserting the inner sleeve 970 within the outer sleeve 930, the inner sleeve is folded slightly in to form a Z-shape and once in place within the outer sleeve, it is snapped into place. In this configuration, the inner sleeve is inserted all the way in to the outer sleeve, with the top most edge of the inner sleeve being aligned with the top most part of the outer sleeve.

Once the inner sleeve has been snapped into place within the interior of the outer sleeve, the apparatus according to FIG. 3 can be used to ship either dry materials or liquid materials within its interior by merely placing a flexible bladder (not illustrated) within its interior and by lining up the discharge port of the internal bladder with the discharge ports of the inner and outer sleeves. As illustrated in FIG. 26, the lid has a fill port 801 in its upper most portion which can be aligned with a fill port on the internal bladder and the materials to be shipped can be pumped through the fill port 801 into the interior of the internal bladder. Once the internal bladder has been filled to its desired level, the fill port for the internal bladder can merely be pushed backed down within the interior of the lid 950.

It should be appreciated in assembling the embodiment of FIG. 29, that the fingers of the bottom 960, one of which is identified by the numeral 961, are intended to be inserted between the outer sleeve and the inner sleeve. Once the lid 940 is attached over the outer sleeve 930 as illustrated in FIG.'s 26 and 30, the strap 950 can be tightened, either before material is placed within the inner bladder or after the material is placed within the inner bladder.

Figure 31:
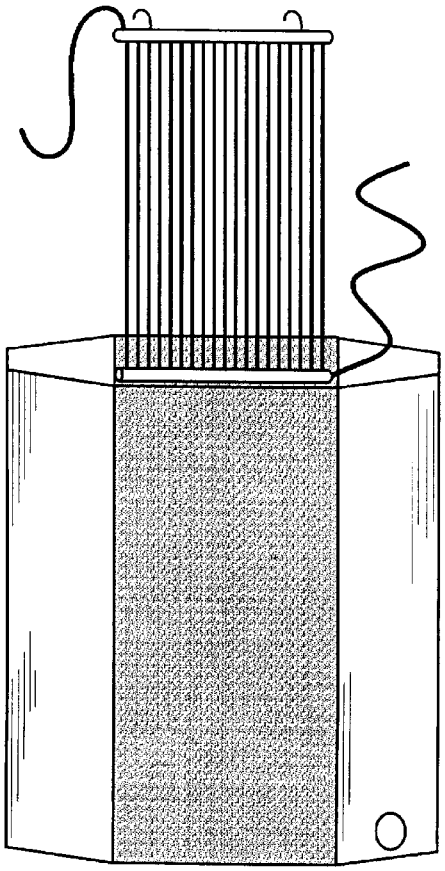
FIG. 31 is an isometric view of the apparatus according to FIG. 26 but having in addition thereto a heat transfer pad which can be used to circulate hot or cold water on the exterior of the inner liner bag to either heat or cool its contents in accordance with the present invention.

Referring now to FIG. 31, there is illustrated a heat exchanger pad 1000 designed to be inserted between the inner sleeve 970 (FIG. 30) and the inner liner bladder (not illustrated) located within the internal sleeve. A set of hangers 106 and 108 at the top end of the pad 1000 allow the pad to be hung off the top edge of the sleeve 970. An upper manifold 1010 and a lower manifold 1012 are connected, respectively, to an output hose 1014 and an input hose 1016. A plurality of conduits 1018 (hoses, pipes, etc) are connected between the manifolds 1010 and 1012.

It should be appreciated that one or more of such heat exchanger pads may be used within a given IBC unit.

In the operation of the pad 1000, if hot water or steam is all that is required, the hot water or steam is coupled into the input hose 1004 and circulated to the output hose 1002, via the lower manifold 1012, the conduits 1018, the upper manifold 1010, and the output hose 1002.

In some applications, for example, if chocolate is being shipped in the inner bladder and is pumped into the bladder while still hot, it will normally continue to "cook" after being pumped into the bladder, a sometimes undesirable scenario. However, by pumping cold water into the input hose 1004, the cooking can be slowed down or stopped, with no damage to the chocolate. Once the shipped product reaches its destination, hot water or steam can be run through the pad 1000, and the chocolate easily pumped out of the bladder. This process (cold water-ship-hot water/steam) can also be used with the heat exchanger pad illustrated and described with respect to FIG. 4.

What is claimed is:

1. A container for shipping materials, comprising:

an inner sleeve comprised of first and second sheets each comprised of five panels, the last panel of said first sheet overlapping the first panel of said second sheet and being heat-welded thereto and the first panel of said first sheet overlapping the last panel of said second sheet and being heat-welded thereto;

an outer sleeve comprised of first and second sheets each comprised of five panels, the last panel of said first sheet overlapping the first panel of said second sheet and being heat-welded thereto, and the first panel of said first sheet overlapping the last panel of said second sheet and being heat-welded thereto, said inner and outer sleeves thus being configured as hexagonal sleeves, with the inner sleeve being snapped into place within the interior of the outer sleeve, and being oriented to have four triple wall sections, with the center point of each of the four sections being every 90° around the periphery of the inner and outer sleeve combined configuration;

an hexagonal-shaped top member sized to fit over the top of the inner and outer sleeve configuration; and an hexagonal-shaped bottom member sized to fit within the bottom of the inner and outer sleeve configuration.

2. The container according to claim 1, wherein said inner sleeve, said outer sleeve, said top member and said bottom member are each comprised of extruded, twin-walled fluted plastic based upon a polypropylene copolymer.

3. The container according to claim 2, including in addition thereto, a flexible bladder located within the interior of the inner sleeve.

4. The container according to claim 3, including in addition thereto, at least one heat exchange pad located between the inner sleeve and the flexible bladder.

5. The container according to claim 3, including in addition thereto, a first fill port in the top member and a second fill port in the flexible bladder.

6. The container according to claim 3, including in addition thereto, a first discharge port in the lower portion of the outer sleeve, a second discharge port in the lower portion of the inner sleeve, and a third discharge port in the lower portion of the flexible bladder, and the first, second and third discharge ports are aligned for facilitating the pumping of the shipped materials out of the container.

* * * * *